US008980509B2

(12) United States Patent
Noguchi et al.

(10) Patent No.: US 8,980,509 B2
(45) Date of Patent: Mar. 17, 2015

(54) ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

(75) Inventors: Kazunori Noguchi, Suntou-gun (JP); Takashi Anezaki, Hiratsuka (JP); Kazuhisa Shida, Mishima (JP); Atsushi Okuda, Yokohama (JP); Shio Murai, Toride (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/988,731

(22) PCT Filed: Nov. 25, 2011

(86) PCT No.: PCT/JP2011/077885
§ 371 (c)(1),
(2), (4) Date: May 21, 2013

(87) PCT Pub. No.: WO2012/074082
PCT Pub. Date: Jun. 7, 2012

(65) Prior Publication Data

US 2013/0236823 A1 Sep. 12, 2013

(30) Foreign Application Priority Data

Dec. 2, 2010 (JP) ..... 2010-269732

(51) Int. Cl.

| | |
|---|---|
| ***G03G 5/047*** | (2006.01) |
| ***G03G 5/05*** | (2006.01) |
| ***G03G 5/06*** | (2006.01) |
| ***G03G 5/147*** | (2006.01) |
| ***G03G 15/00*** | (2006.01) |

(52) U.S. Cl.
CPC ..... *G03G 5/0589* (2013.01); *G03G 5/0629* (2013.01); *G03G 5/056* (2013.01); *G03G 5/0564* (2013.01); *G03G 5/0578* (2013.01); *G03G 5/0614* (2013.01); *G03G 5/14752* (2013.01); *G03G 5/14756* (2013.01); *G03G 5/14773* (2013.01); *G03G 15/75* (2013.01)
USPC ..... 430/58.2; 430/59.6; 430/66; 430/133

(58) Field of Classification Search
CPC . G03G 5/0629; G03G 5/0589; G03G 5/0564; G03G 5/0614
USPC ..... 430/58.2, 59.6, 66, 133; 399/111, 159
See application file for complete search history.

(56) References Cited

U.S. PATENT DOCUMENTS

| | | | | |
|---|---|---|---|---|
| 6,991,881 | B2 | 1/2006 | Ogaki et al. | |
| 6,994,941 | B2 | 2/2006 | Tanaka et al. | |
| 7,001,699 | B2 | 2/2006 | Tanaka et al. | |
| 7,045,261 | B2 | 5/2006 | Tanaka et al. | |
| 7,171,142 | B2 | 1/2007 | Kawakami et al. | |
| 7,413,840 | B1 | 8/2008 | Ogaki et al. | |
| 7,551,878 | B2 | 6/2009 | Ogaki et al. | |
| 7,553,594 | B2 | 6/2009 | Ogaki et al. | |
| 7,556,901 | B2 | 7/2009 | Anezaki et al. | |
| 7,585,604 | B2 | 9/2009 | Ogaki et al. | |
| 7,622,238 | B2 | 11/2009 | Uematsu et al. | |
| 7,629,102 | B2 | 12/2009 | Ochi et al. | |
| 7,645,547 | B2 | 1/2010 | Okuda et al. | |
| 7,655,370 | B2 | 2/2010 | Kitamura et al. | |
| 7,704,657 | B2 | 4/2010 | Uesugi et al. | |
| 7,718,331 | B2 | 5/2010 | Uematsu et al. | |
| 7,749,667 | B2 | 7/2010 | Kawahara et al. | |
| 7,799,496 | B2 | 9/2010 | Uesugi et al. | |
| 7,838,190 | B2 | 11/2010 | Ogaki et al. | |
| 7,875,410 | B2 | 1/2011 | Ogaki et al. | |
| 7,901,855 | B2 | 3/2011 | Ogaki et al. | |
| 7,927,774 | B2 | 4/2011 | Ogaki et al. | |
| 7,931,848 | B2 | 4/2011 | Ochi et al. | |
| 8,455,170 | B2 | 6/2013 | Nakamura et al. | |
| 8,457,528 | B2 | 6/2013 | Ochi et al. | |
| 2010/0092208 | A1* | 4/2010 | Ogaki et al. | 430/58.2 |
| 2011/0158683 | A1 | 6/2011 | Okuda et al. | |
| 2011/0177438 | A1 | 7/2011 | Noguchi et al. | |
| 2012/0114375 | A1 | 5/2012 | Fujii et al. | |
| 2012/0243904 | A1 | 9/2012 | Okuda et al. | |
| 2012/0301181 | A1 | 11/2012 | Ogaki et al. | |
| 2012/0301182 | A1 | 11/2012 | Anezaki et al. | |
| 2013/0202326 | A1 | 8/2013 | Shida et al. | |
| 2013/0202327 | A1 | 8/2013 | Murai et al. | |
| 2013/0221560 | A1 | 8/2013 | Kawai et al. | |
| 2013/0316283 | A1 | 11/2013 | Fujii et al. | |
| 2013/0323632 | A1 | 12/2013 | Fujii et al. | |

FOREIGN PATENT DOCUMENTS

| | | | | |
|---|---|---|---|---|
| JP | 5-43670 | A | | 2/1993 |
| JP | 5-158249 | A | | 6/1993 |
| JP | 05155999 | A | * | 6/1993 |
| JP | 8-234468 | A | | 9/1996 |
| JP | 8-262752 | A | | 10/1996 |
| JP | 2002214807 | A | * | 7/2002 |
| JP | 2007-79555 | A | | 3/2007 |
| JP | 2009-180760 | A | | 8/2009 |
| JP | 4764953 | B1 | | 9/2011 |
| WO | 2010/008095 | A1 | | 1/2010 |
| WO | WO 2011071093 | A1 | * | 6/2011 |

OTHER PUBLICATIONS

English language machine translation of JP 2002-214807 (Jul. 2002).*

(Continued)

*Primary Examiner* — Christopher Rodee
(74) *Attorney, Agent, or Firm* — Fitzpatrick, Cella, Harper and Scinto

(57) ABSTRACT

An electrophotographic photosensitive member comprises a charge-transporting layer which is a surface layer of the electrophotographic photosensitive member; wherein the charge-transporting layer has a matrix-domain structure having: a matrix comprising a component β and a component γ, and a domain comprising a component α.

6 Claims, 1 Drawing Sheet

(56) References Cited

OTHER PUBLICATIONS

PCT International Search Report and Written Opinion of the International Searching Authority, International Application No. JP2011/077885, Mailing Date Dec. 27, 2011.

Sekiya, et al., U.S. Appl. No. 13/930,341, filed Jun. 28, 2013.
Okuda, et al., U.S. Appl. No. 13/930,383, filed Jun. 28, 2013.
Kaku, et al., U.S. Appl. No. 13/930,368, filed Jun. 28, 2013.
Yamamoto, et al., U.S. Appl. No. 14/030,995, filed Sep. 18, 2013.
Chinese Office Action dated Jan. 5, 2015 in Chinese Application No. 201180057775.7.

* cited by examiner

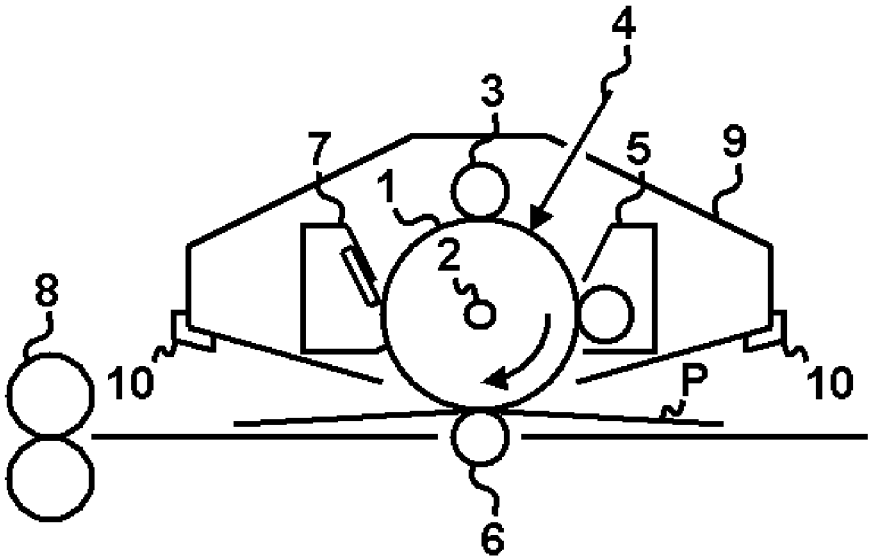
4
3
7
5
9
1
2
8
10
10
P
6

ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

TECHNICAL FIELD

The present invention relates to an electrophotographic photosensitive member, a process cartridge, an electrophotographic apparatus, and a method of manufacturing an electrophotographic photosensitive member.

BACKGROUND ART

An organic electrophotographic photosensitive member (hereinafter, referred to as "electrophotographic photosensitive member") containing an organic charge-generating substance (organic photoconductive substance) is known as an electrophotographic photosensitive member mounted on an electrophotographic apparatus. In an electrophotographic process, a variety of members such as a developer, a charging member, a cleaning blade, paper, and a transferring member (hereinafter, also referred to as "contact member or the like") have contact with the surface of the electrophotographic photosensitive member. Therefore, the electrophotographic photosensitive member is required to reduce generation of image deterioration due to contact stress with such contact members or the like. In particular, in recent years, the electrophotographic photosensitive member is required to have a sustained effect of reducing the image deterioration due to contact stress with improvement of durability of the electrophotographic photosensitive member.

For sustained reduction of contact stress, Patent Literature 1 has proposed a method of forming a matrix-domain structure in the surface layer using a siloxane resin obtained by integrating a siloxane structure into a molecular chain. In particular, the literature shows that use of a polyester resin integrated with a specific siloxane structure can achieve an excellent balance between sustained reduction of contact stress and potential stability (suppression of variation) in repeated use of the electrophotographic photosensitive member.

On the other hand, there has been proposed a technology for adding a siloxane-modified resin having a siloxane structure in its molecular chain to a surface layer of an electrophotographic photosensitive member. Patent Literature 2 and Patent Literature 3 have each proposed an electrophotographic photosensitive member containing a polycarbonate resin integrated with a siloxane structure having a specific structure and a polyester resin integrated with a siloxane structure having a specific structure, and effects such as improvements in sliding property and durability of the surface of the photosensitive member.

CITATION LIST

Patent Literature

PTL 1: International Patent WO 2010/008095A

PTL 2: Japanese Patent Application Laid-Open No. H05-158249

PTL 3: Japanese Patent Application Laid-Open No. H08-234468

SUMMARY OF INVENTION

Technical Problem

The electrophotographic photosensitive member disclosed in Patent Literature 1 has an excellent balance between sustained reduction of contact stress and potential stability in repeated use. However, the inventors of the present invention have made studies, and as a result, the inventors have found that, in the case of using a charge-transporting substance having a specific structure, the potential stability in repeated use can further be improved.

Patent Literature 2 has reported that a polycarbonate resin having a siloxane structure in the side chain is used to improve the sliding property of the surface of an electrophotographic photosensitive member. However, the electrophotographic photosensitive member of Patent Literature 2 does not sufficiently achieve an excellent balance between a sustained reduction of contact stress and potential stability (suppression of variation) in repeated use of the electrophotographic photosensitive member.

Patent Literature 3 has reported that, in a photosensitive member containing a resin integrated with a siloxane structure, the sliding property and abrasion resistance of the surface are improved. However, the electrophotographic photosensitive member of Patent Literature 3 does not sufficiently achieve an excellent balance between a sustained reduction of contact stress and potential stability (suppression of variation) in repeated use of the electrophotographic photosensitive member.

An object of the present invention is to provide an electrophotographic photosensitive member containing a specific charge-transporting substance, which has an excellent balance between sustained reduction of contact stress with a contact member or the like and potential stability in repeated use. Another object of the present invention is to provide a process cartridge having the electrophotographic photosensitive member and an electrophotographic apparatus having the electrophotographic photosensitive member. A further object of the present invention is to provide a method of manufacturing the electrophotographic photosensitive member.

Solution to Problem

The above-mentioned objects are achieved by the following present invention.

The present invention relates to an electrophotographic photosensitive member, comprising: a conductive support, a charge-generating layer which is provided on the conductive support and comprises a charge-generating substance, and a charge-transporting layer which is provided on the charge-generating layer and is a surface layer of the electrophotographic photosensitive member; wherein the charge-transporting layer has a matrix-domain structure having: a domain which comprises a polyester resin A having a repeating structural unit represented by the following formula (A) and a repeating structural unit represented by the following formula (B); and a matrix which comprises, at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1), a compound represented by the following formula (1'), a compound represented by the following formula (2), and a compound represented by the following formula (2'); wherein the content of a siloxane moiety in the polyester resin A is not less than 5.0% by mass and not more than 40% by mass relative to the total mass of the polyester resin A.

(A)

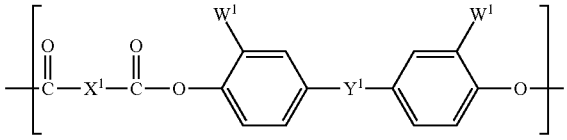

In the formula (A), $Y^1$ represents a single bond, a methylene group, an ethylidene group, a propylidene group, a phenylethylidene group, a cyclohexylidene group, or an oxygen atom; $X^1$ represents a meta-phenylene group, a para-phenylene group, or a bivalent group having two para-phenylene groups bonded with an oxygen atom; and $W^1$ represents an univalent group represented by the following formula (a), or an univalent group represented by the following formula (b).

(a)

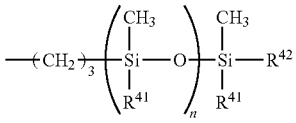

(b)

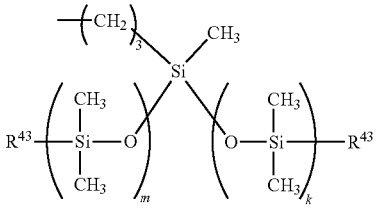

In the formulae (a) and (b), $R^{41}$ represents a methyl group or a phenyl group, $R^{42}$ and $R^{43}$ each independently represents an alkyl group having 1 to 4 carbon atoms, "n" represents the number of repetitions of a structure within brackets, an average of "n" in the polyester resin A ranges from 10 to 150; "m" and "k" each independently represents the number of repetitions of a structure within brackets, an average of "m+k" in the polyester resin A ranges from 10 to 150.

(B)

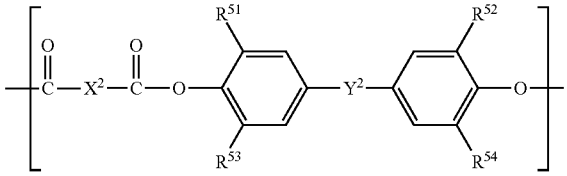

In the formula (B), $R^{51}$ to $R^{54}$ each independently represents a hydrogen atom, or a methyl group, $X^2$ represents a meta-phenylene group, a para-phenylene group, or a bivalent group having two para-phenylene groups bonded with an oxygen atom, and $Y^2$ represents a single bond, a methylene group, an ethylidene group, a propylidene group, a phenylethylidene group, a cyclohexylidene group, or an oxygen atom.

(C)

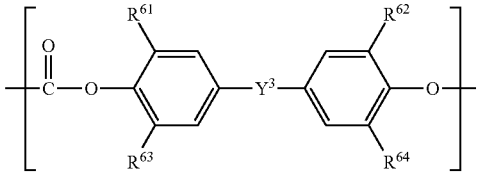

In the formula (C), $R^{61}$ to $R^{64}$ each independently represents a hydrogen atom, or a methyl group, and $Y^3$ represents a single bond, a methylene group, an ethylidene group, a propylidene group, a phenylethylidene group, a cyclohexylidene group, or an oxygen atom.

(D)

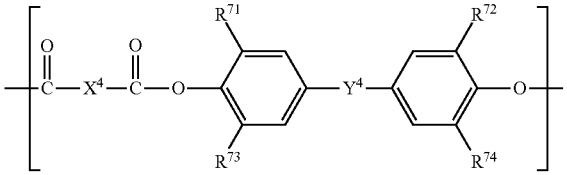

In the formula (D), $R^{71}$ to $R^{74}$ each independently represents a hydrogen atom, or a methyl group, $X^4$ represents a meta-phenylene group, a para-phenylene group, and a bivalent group having two para-phenylene groups bonded with an oxygen atom, and $Y^4$ represents a single bond, a methylene group, an ethylidene group, a propylidene group, a cyclohexylidene group, or an oxygen atom.

(1)

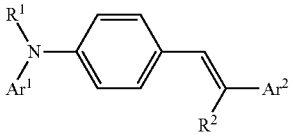

(1')

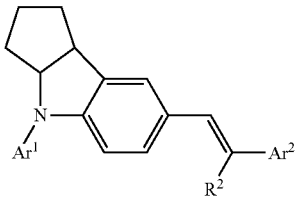

In the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group.

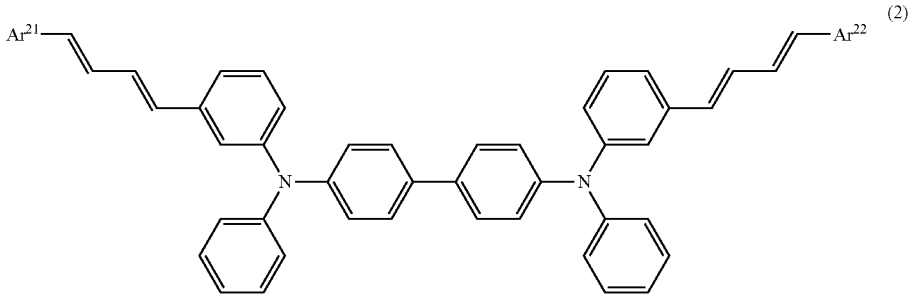

(2)

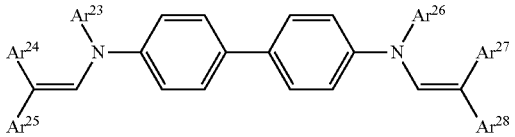

(2')

In the formulae (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

The present invention also relates to a process cartridge detachably attachable to a main body of an electrophotographic apparatus, wherein the process cartridge integrally supports: the electrophotographic photosensitive member; and at least one device selected from the group consisting of a charging device, a developing device, a transferring device, and a cleaning device.

The present invention also relates to an electrophotographic apparatus, comprising: the electrophotographic photosensitive member; a charging device; an exposing device; a developing device; and a transferring device.

The present invention also relates to a method of manufacturing the electrophotographic photosensitive member, wherein the method comprises a step of forming the charge-transporting layer by applying a charge-transporting-layer coating solution on the charge-generating layer and drying the coating solution, and wherein the charge-transporting-layer coating solution comprises: the polyester resin A, at least one resin selected from the group consisting of the polycarbonate resin C and the polyester resin D, and at least one charge-transporting substance selected from the group consisting of the compound represented by the formula (1), the compound represented by the formula (1'), the compound represented by the formula (2), and the compound represented by the formula (2').

Advantageous Effects of Invention

According to the present invention, it is possible to provide the electrophotographic photosensitive member containing a specific charge-transporting substance, which has an excellent balance between sustained reduction of contact stress with a contact member or the like and potential stability in repeated use. Moreover, according to the present invention, it is also possible to provide the process cartridge having the electrophotographic photosensitive member and the electrophotographic apparatus having the electrophotographic photosensitive member. Further, according to the present invention, it is also possible to provide the method of manufacturing the electrophotographic photosensitive member.

Further features of the present invention will become apparent from the following description of exemplary embodiments with reference to the attached drawing.

BRIEF DESCRIPTION OF DRAWING

FIGURE is a diagram that schematically shows the construction of an electrophotographic apparatus including a process cartridge having an electrophotographic photosensitive member of the present invention.

DESCRIPTION OF EMBODIMENTS

Hereinafter, a polyester resin A is referred to as component α. At least one resin selected form the group consisting of a polycarbonate resin C having a repeating structural unit represented by the formula (C) and a polyester resin D having a repeating structural unit represented by the formula (D) is referred to as component β. At least one charge-transporting substance selected from the group consisting of a compound represented by the formula (1), a compound represented by the formula (1'), a compound represented by the formula (2), and a compound represented by the formula (2') is referred to as component γ.

As described above, an electrophotographic photosensitive member of the present invention includes: a conductive support, a charge-generating layer which is provided on the conductive support and comprises a charge-generating substance, and a charge-transporting layer which is provided on the charge-generating layer and is a surface layer of the electrophotographic photosensitive member, in which the charge-transporting layer has a matrix-domain structure having: a matrix which includes a component β and a component γ; and a domain which includes a component α.

When the matrix-domain structure of the present invention is compared to a "sea-island structure," the matrix corresponds to the sea, and the domain corresponds to the island. The domain including the component α has a granular (island-like) structure formed in the matrix including the components β and γ. The domain including the component α is present in the matrix as an independent domain. Such matrix-domain structure can be confirmed by observing the surface of the charge-transporting layer or the cross-sectional surface of the charge-transporting layer.

Observation of a state of the matrix-domain structure or determination of the domain structure can be performed by using, for example, a commercially available laser microscope, a light microscope, an electron microscope, or an atomic force microscope. Observation of the state of the matrix-domain structure or determination of the domain structure can be performed by using any of the above-mentioned microscopes at a predetermined magnification.

The number average particle size of the domain including the component α in the present invention is preferably not less than 100 nm and not more than 1,000 nm. Further, the particle size distribution of the particle sizes of each domain is preferably narrow from the viewpoint of sustained effect of reducing contact stress. The number average particle size in the present invention is determined by arbitrarily selecting 100 of domains confirmed by observing the cross-sectional surface obtained by vertically cutting the charge-transporting layer of the present invention by the above-mentioned microscope. Then, the maximum diameters of the respective selected domains are measured and averaged to calculate the number average particle size of each domain. It should be noted that if the cross-sectional surface of the charge-transporting layer is observed by the microscope, image information in a depth direction can be obtained to provide a three-dimensional image of the charge-transporting layer.

The matrix-domain structure of the charge-transporting layer in the electrophotographic photosensitive member of the present invention can be formed by using a charge-transporting-layer coating solution which contains the components α, β, and γ. In addition, the electrophotographic photosensitive member of the present invention can be manufactured by applying the charge-transporting-layer coating solution on the charge-generating layer, and drying the coating solution, thereby forming the charge-transporting layer.

The matrix-domain structure of the present invention is a structure in which the domain including the component α is formed in the matrix including the components β and γ. It is considered that the effect of reducing contact stress is sustainably exerted by forming the domain including the component α not only on the surface of the charge-transporting layer but also in the charge-transporting layer. Specifically, this is probably because the siloxane resin component having an effect of reducing contact stress, which is reduced by a friction of a member such as paper or a cleaning blade, can be supplied from the domain in the charge-transporting layer.

The inventors of the present invention have found that, in the case where a charge-transporting substance having a specific structure is used as the charge-transporting substance, the potential stability in repeated use may further be improved. Further, the inventors have estimated the reason of further enhancement of the potential stability in repeated use in an electrophotographic photosensitive member containing the specific charge-transporting substance (the component γ) of the present invention, as follows.

In the electrophotographic photosensitive member including the charge-transporting layer having the matrix-domain structure of the present invention, it is important to reduce the charge-transporting substance content in the domain of the formed matrix-domain structure as much as possible for suppressing a potential variation in repeated use. In the case where compatibility between the charge-transporting substance and a resin integrated with the siloxane structure which forms the domain is high, the charge-transporting substance content in the domain becomes high, resulting in aggregation, and charges are captured in the charge-transporting substance in the domain in repeated use of the photosensitive member, resulting in insufficient potential stability.

In order to achieve an excellent balance between potential stability in repeated use and sustained reduction of contact stress in the electrophotographic photosensitive member containing the charge-transporting substance having a specific structure, it is necessary to improve the property by a resin integrated with the siloxane structure. The component γ in the present invention is a charge-transporting substance having high compatibility with the resin in the charge-transporting layer, and aggregates of the component γ may be easy to form because the component γ is contained in a large amount in the domain including the siloxane-containing resin.

In the present invention, excellent charge-transporting ability can be maintained by forming a domain including the component α of the present invention in the electrophotographic photosensitive member including the component γ. This is probably because the content of the component γ in the domain is reduced by forming the domain including the component α. This is probably because a branched siloxane structure in the polyester resin A which is the component α can suppress remaining of the component γ having a structure compatible with the resin in the domain.

<Component γ>

The component γ of the present invention is at least one charge-transporting substance selected from the group consisting of a compound represented by the following formula (1), a compound represented by the following formula (1'), a compound represented by the following formula (2), and a compound represented by the following formula (2').

(1)

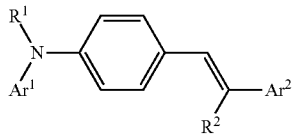

(1')

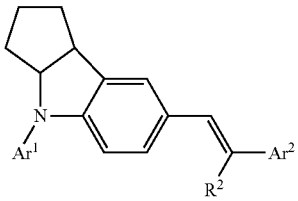

In the formulae (1) and (1'): $Ar^1$ represents a phenyl group or a phenyl group substituted with a methyl group or an ethyl group. $Ar^2$ represents a phenyl group, a phenyl group substituted with a methyl group, a phenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), or a biphenyl group substituted with an univalent group represented by the formula "—CH═CH—Ta". $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represent a phenyl group or a phenyl group substituted with a methyl group). $R^2$ represents a hydrogen atom, a phenyl group, or a phenyl group substituted with a methyl group.

(2)

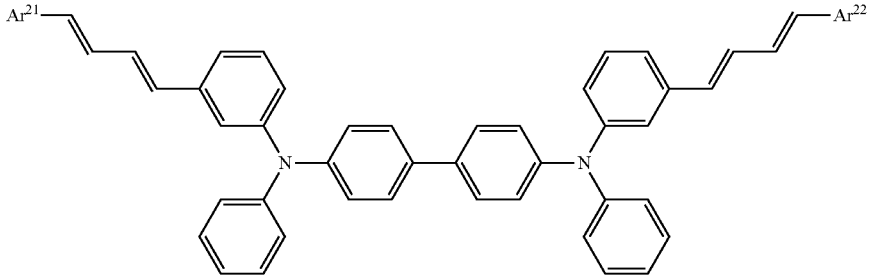

(2')

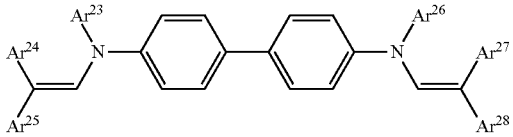

In the formula (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

Specific examples of the charge-transporting substance which is the component γ and has the structure represented by the above-mentioned formula (1), (1'), (2), or (2') are shown below.

(1-1)

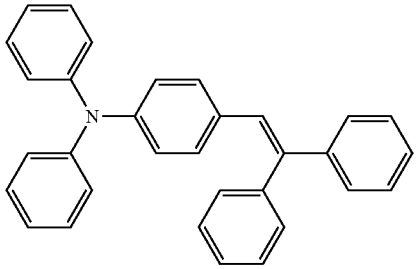

(1-2)

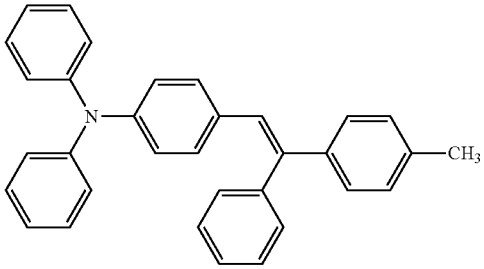

(1-3)

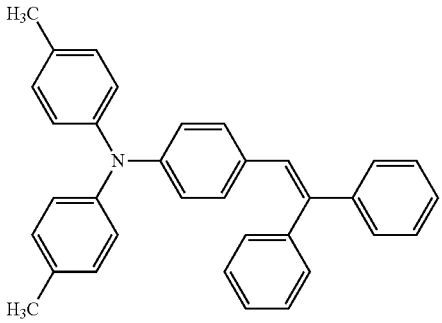

(1-4)

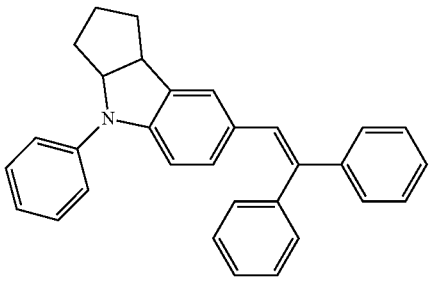

(1-5)

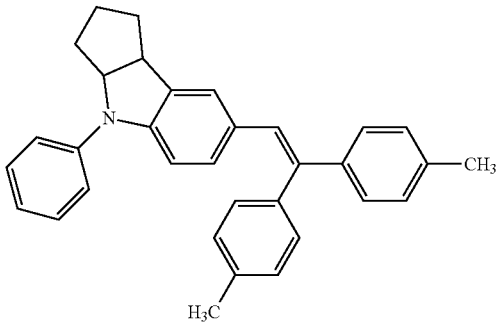

(1-6)

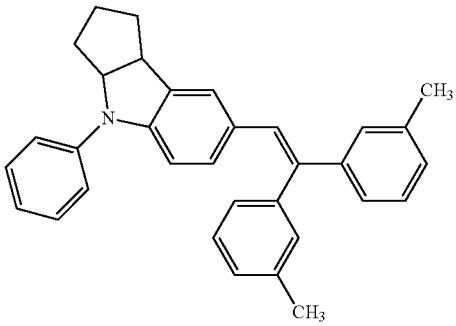

-continued
(1-7)
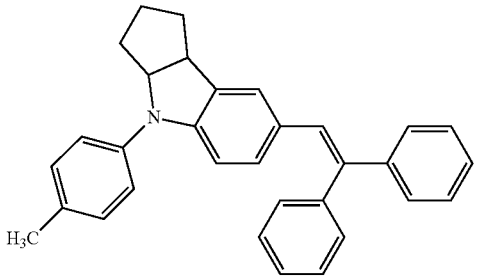
(1-8)
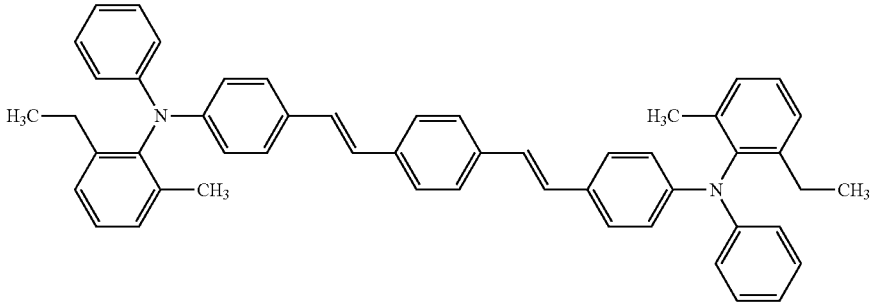
(1-9)
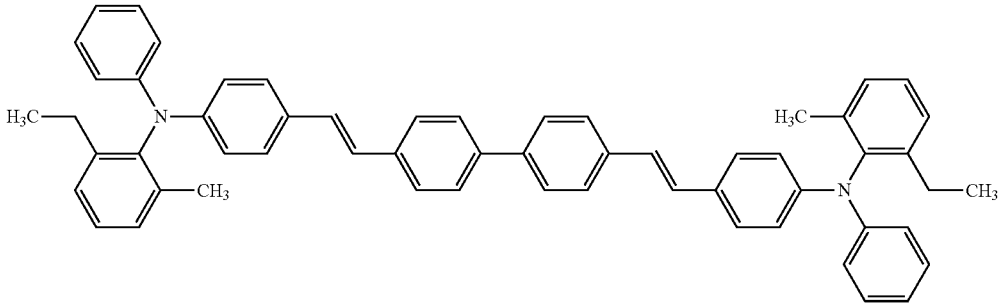
(1-10)
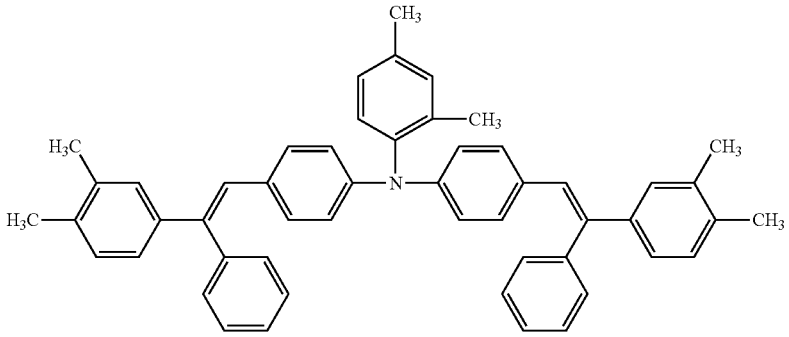
(1-11)
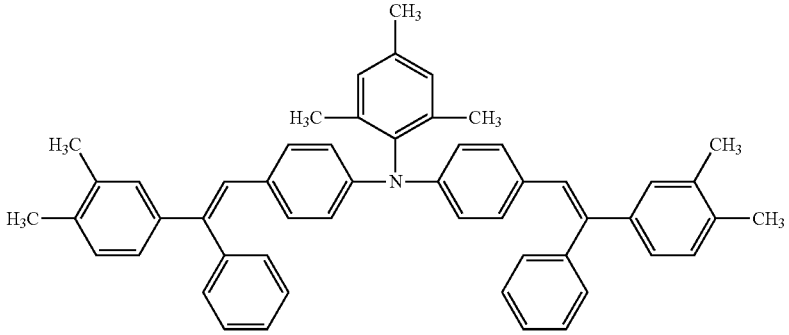

-continued
(2-1)
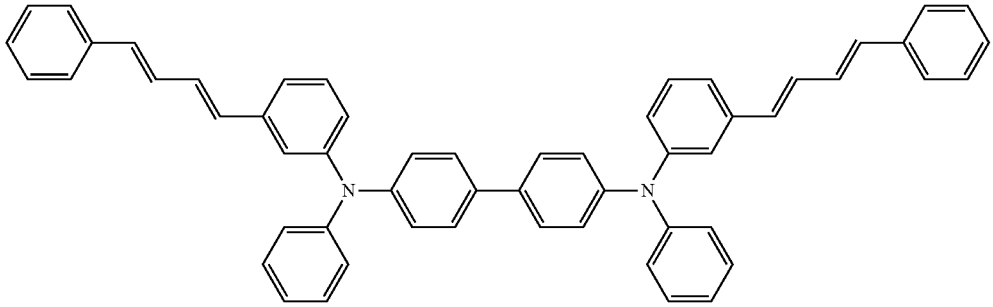
(2-2)
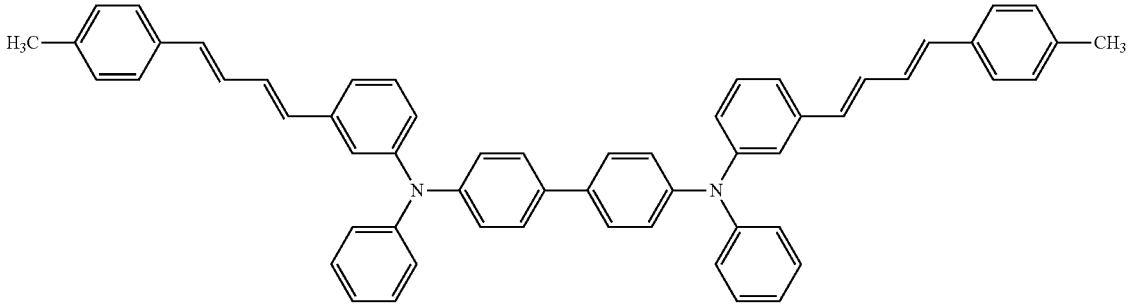
(2-3)
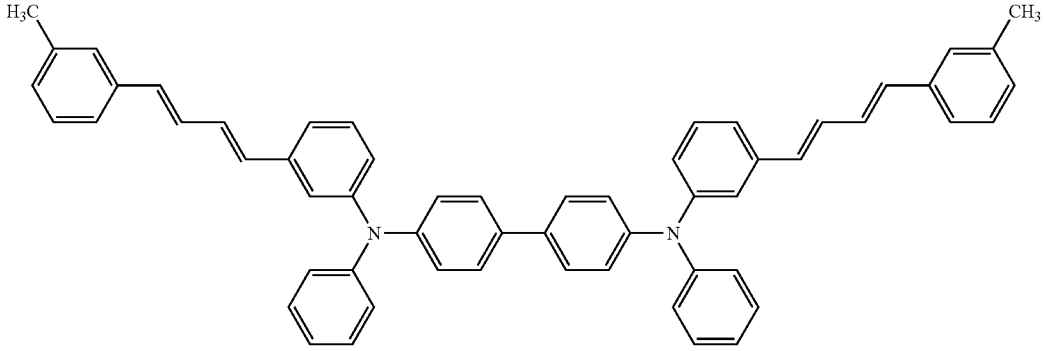
(2-4)
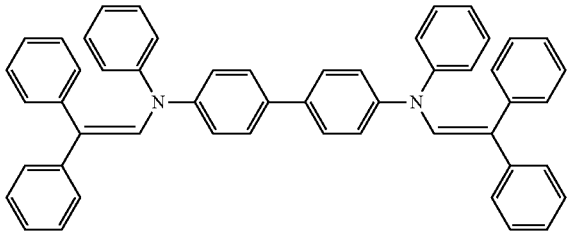
(2-5)
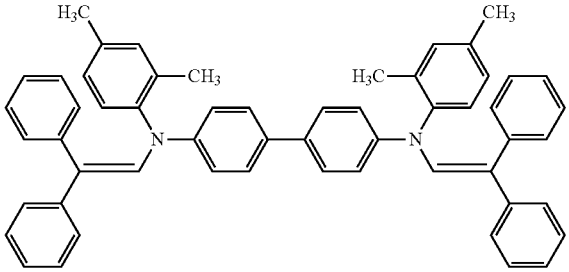
(2-6)
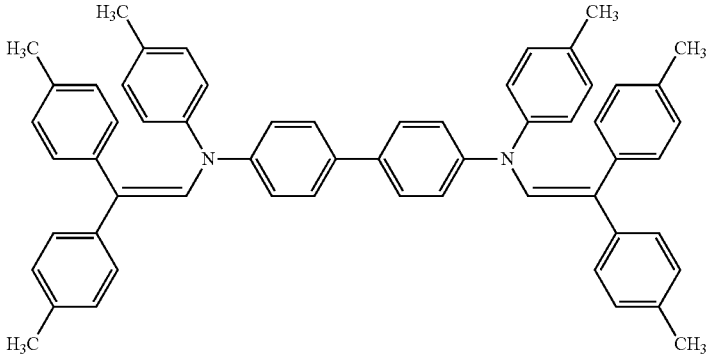

Of those, the component γ is preferably a charge-transporting substance having the structure represented by the above-mentioned formula (1-2), (1-3), (1-4), (1-5), (1-7), (1-8), (1-9), (2-1), or (2-5).

<Component α>

The component α of the present invention is a polyester resin A having a repeating structural unit represented by the following formula (A) and a repeating structural unit represented by the following formula (B). The content of a siloxane moiety in the polyester resin A is not less than 5.0% by mass (5% by mass) and not more than 40% by mass.

(A)

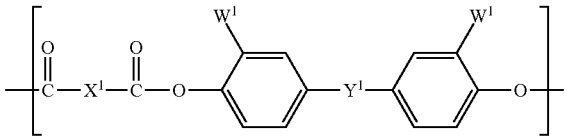

In the formula (A): $Y^1$ represents a single bond, a methylene group, an ethylidene group, a propylidene group, a phenylethylidene group, a cyclohexylidene group, or an oxygen atom; $X^1$ represents a meta-phenylene group, a para-phenylene group, or a bivalent group having two para-phenylene groups bonded with an oxygen atom; and $W^1$ represents an univalent group represented by the following formula (a), or an univalent group represented by the following formula (b).

(a)

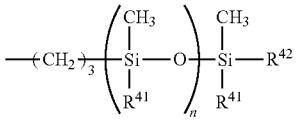

(b)

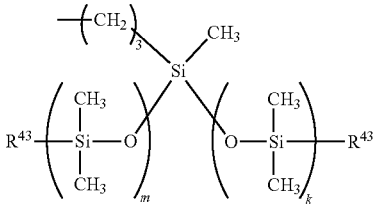

In the formulae (a) and (b): $R^{41}$ represents a methyl group or a phenyl group; $R^{42}$ and $R^{43}$ each independently represents an alkyl group having 1 to 4 carbon atoms; "n" represents the number of repetitions of a structure within brackets, an average of "n" in the polyester resin A ranges from 10 to 150; "m" and "k" each independently represents the number of repetitions of a structure within brackets, an average of "m+k" in the polyester resin A ranges from 10 to 150.

(B)

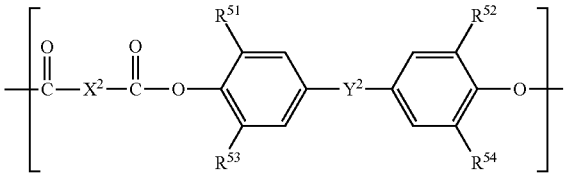

In the formula (B): $R^{51}$ to $R^{54}$ each independently represents a hydrogen atom or a methyl group; $X^2$ represents a meta-phenylene group, a para-phenylene group, or a bivalent group having two para-phenylene groups bonded with an oxygen atom; and $Y^2$ represents a single bond, a methylene group, an ethylidene group, a propylidene group, a phenylethylidene group, a cyclohexylidene group, or an oxygen atom.

Hereinafter, the polyester resin A which is the component α and has a repeating structural unit represented by the above-mentioned formula (A) and a repeating structural unit represented by the above-mentioned formula (B) is described.

Specific examples of the repeating structural unit represented by the above-mentioned formula (A) are shown below.

(A-1)

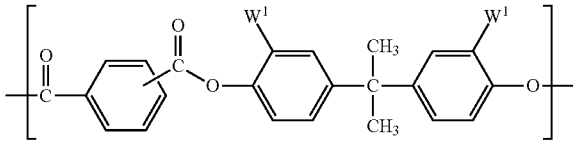

(A-2)

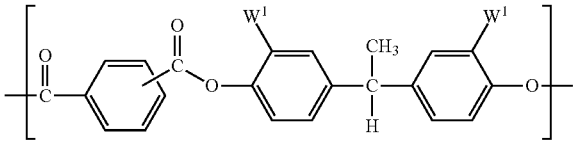

(A-3)

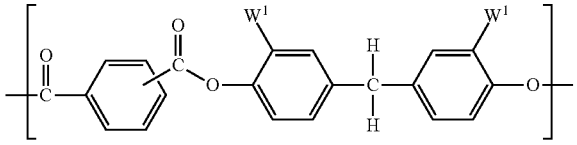

(A-4)

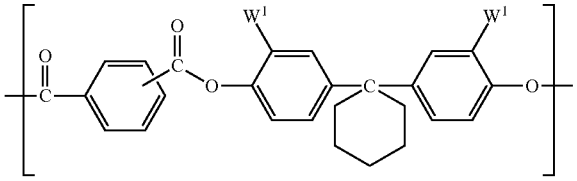

-continued (A-5)

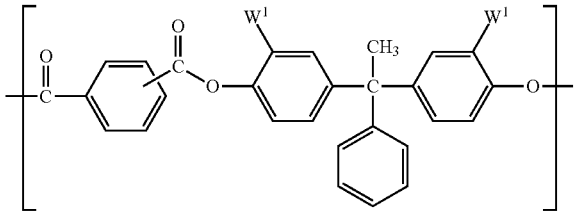

(A-6)

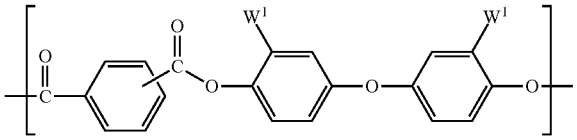

(A-7)

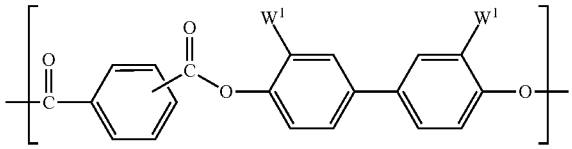

(A-8)

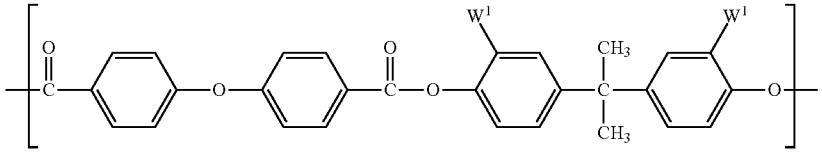

(A-9)

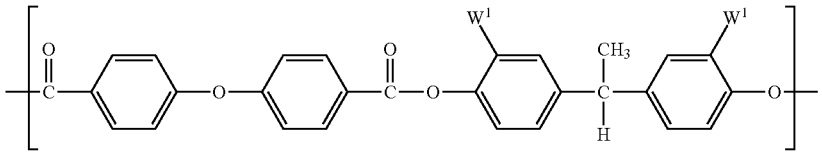

(A-10)

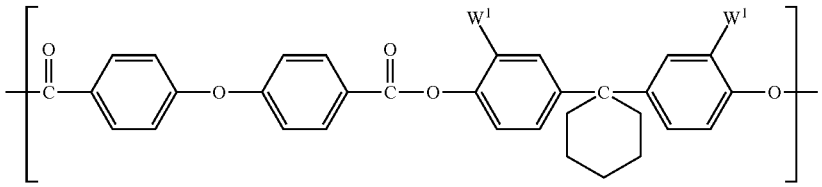

(A-11)

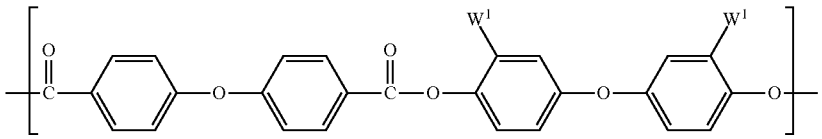

(A-12)

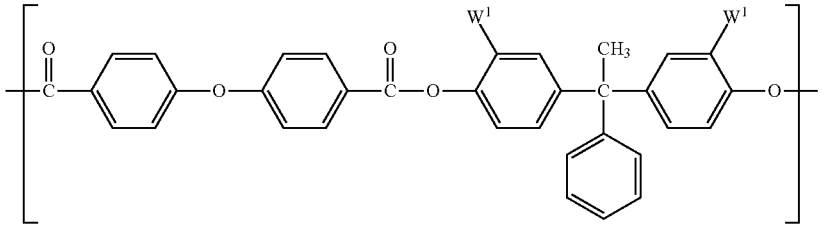

Of those, the repeating structural unit represented by the above-mentioned formula (A) is preferably a repeating structural unit represented by one of the above-mentioned formulae (A-1) and (A-2).

$W^1$ in the structural unit represented by one of the above-mentioned formulae (A-1) to (A-12) represents a univalent group represented by the formula (a) or the formula (b).

In the above-mentioned formulae (a) and (b), an average of "n" in the polyester resin A is 10 or more to 150 or less. In addition, from the viewpoint of the excellent balance between sustained reduction of contact stress and potential stability in repeated use, the average of "n" is preferably 30 or more to 100 or less. With regard to "m" and "k" in the formula (b), an average of "m+k" in the polyester resin A is 10 or more to 150 or less. Moreover, from the viewpoint of the excellent balance between sustained reduction of contact stress and potential stability in repeated use, the average of "m+k" is preferably 30 or more to 100 or less.

In the above-mentioned formula (a), it is preferred that the number of repetitions "n" of the structure within the brackets fall within the range of ±10% of the value represented as the average of the number of repetitions "n" because the effect of the present invention can be obtained stably. In the above-mentioned formula (b), it is preferred that "m+k", i.e., a sum of "m" and "k", which are the numbers of repetitions of the structures within the brackets, fall within the range of ±10% of the value represented as the average of the numbers of repetitions of "m+k" because the effect of the present invention can be obtained stably.

Specific examples of structures represented by the above-mentioned formulae (a) and (b) are shown.

(a-1)

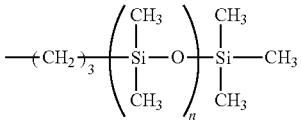

(a-2)

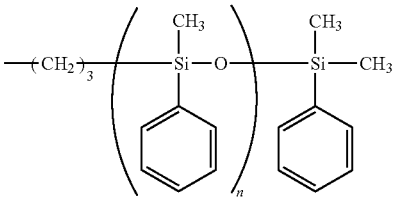

(a-3)

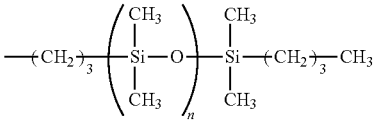

-continued (a-4)

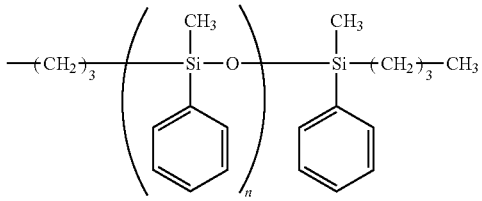

(b-1)

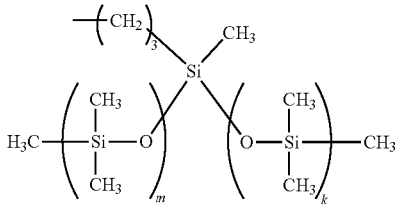

(b-2)

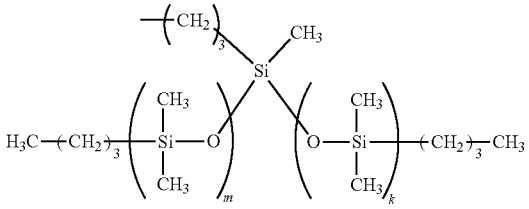

Of those, the structure represented by the above-mentioned formula (a-1) or (a-3) is preferred.

Next, the repeating structural unit represented by the above-mentioned formula (B) is described. Specific examples of the repeating structural unit represented by the above-mentioned formula (B) are shown below.

(B-1)

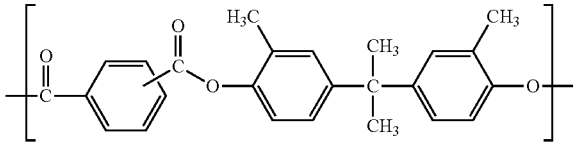

(B-2)

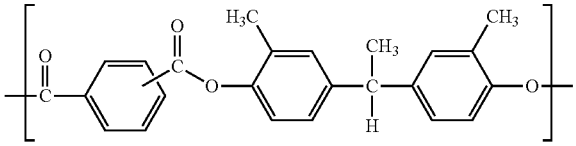

(B-3)

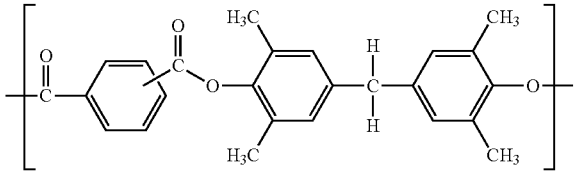

(B-4)

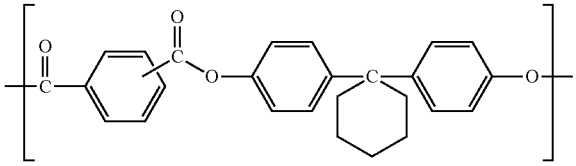

(B-5)

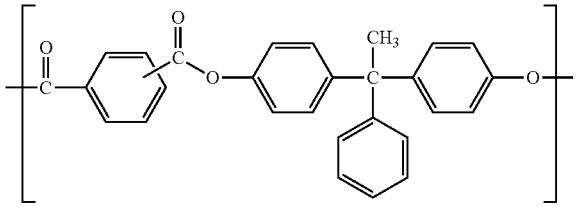

(B-6)

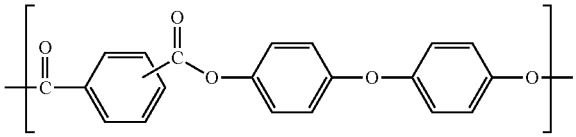

-continued (B-7)

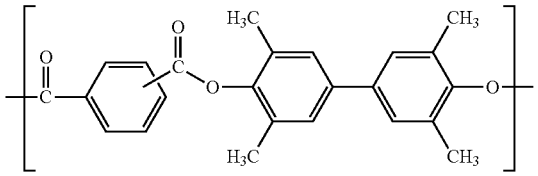

(B-8)

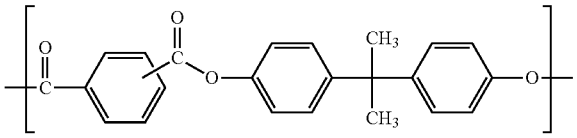

(B-9)

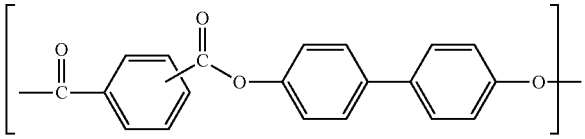

(B-10)

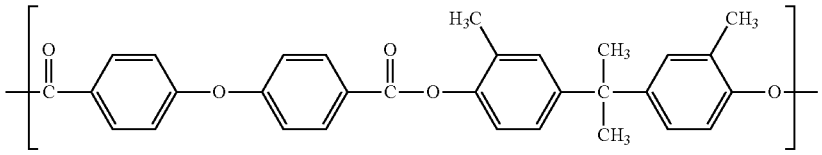

(B-11)

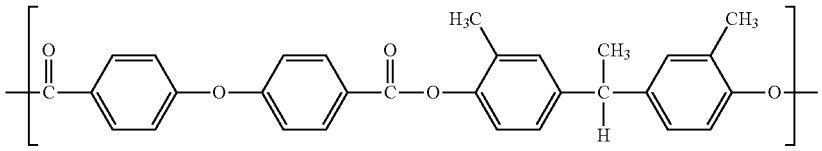

(B-12)

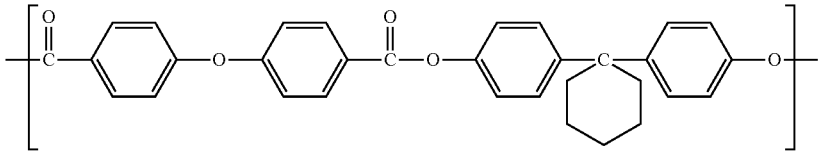

Of those, the repeating structural unit represented by the above-mentioned formula (B-1), (B-2), (B-6), (B-11), or (B-12) is preferred.

In addition, the polyester resin A which is the above-mentioned component α of the present invention contains a siloxane moiety at a content of not less than 5.0% by mass and not more than 40% by mass relative to the total mass of the polyester resin A. If the content of the siloxane moiety is less than 5.0% by mass (5% by mass), a sustained effect of reducing contact stress is insufficient, and a domain is not formed effectively in the matrix containing the component β or γ. Meanwhile, if the content of the siloxane moiety is more than 40% by mass, the component γ forms aggregates in the domain including the component α, resulting in insufficient potential stability in repeated use.

In the present invention, the siloxane moiety is a moiety which includes silicon atoms present at the both ends of the siloxane structure, groups bonded to the silicon atoms, and oxygen atoms, silicon atoms, and groups bonded to the atoms present between the silicon atoms present at the both ends. Specifically, for example, the siloxane moiety refers to the moiety surrounded by the dashed line in the repeating structural unit represented by the following formula (A-S).

(A-S)

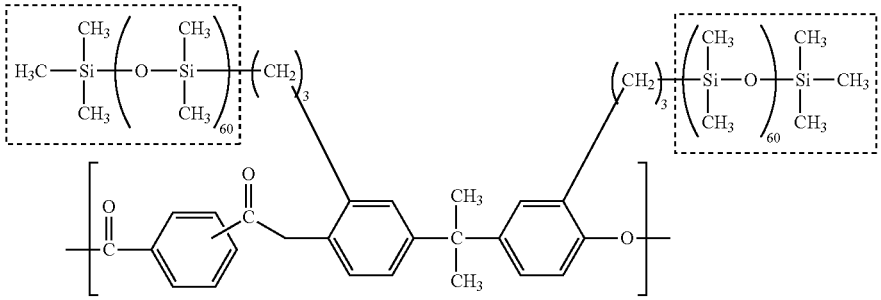

That is, the structure shown below represents the siloxane moiety in the above-mentioned formula (A-S). In addition, structures of the siloxane moieties in the formula (a) and (b) are also shown below.

Siloxane moiety in formula (A-S)

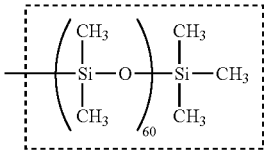

Siloxane moiety in formula (a)

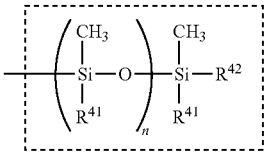

Siloxane moiety in formula (b)

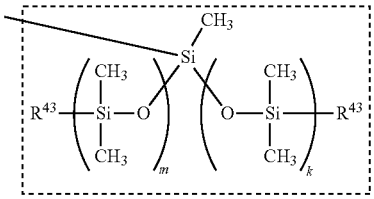

The content of the siloxane moiety relative to the total mass of the polyester resin A which is the component α of the present invention can be analyzed by a general analysis technology. An example of the analysis technology is shown below.

First, the charge-transporting layer which is the surface layer of the electrophotographic photosensitive member is dissolved with a solvent. After that, a variety of materials in the charge-transporting layer which is the surface layer are fractionated using a fractionation apparatus capable of separating and collecting components, such as size exclusion chromatography or high-performance liquid chromatography. Structures of component materials in a fractionated polyester resin A which is the component α and contents of the materials can be determined by a conversion method based on peak positions and peak area ratios of hydrogen atoms (hydrogen atom which is included in the resin) measured by $^{1}$H-NMR measurement. The number of repetitions of the siloxane moiety and a molar ratio are calculated from the results and converted into content (mass ratio). Moreover, the fractionated polyester resin A which is the component α is hydrolyzed in the presence of an alkali to decompose the component into a carboxylic acid moiety and a bisphenol moiety. Nuclear magnetic resonance spectrum analysis or mass spectrometry is performed for the resultant bisphenol moiety to calculate the number of repetitions of the siloxane moiety and a molar ratio, which are converted into a content (mass ratio).

In the present invention, the mass ratio of the siloxane moiety in the polyester resin A which is the component α was measured by the above-mentioned technology.

Further, the mass ratio of the siloxane moiety in the polyester resin A which is the component α relates to the amount of a raw material of a monomer unit containing the siloxane moiety used in polymerization, and hence the amount of the raw material used was adjusted to achieve a desired mass ratio of the siloxane moiety.

The polyester resin A which is used as the above-mentioned component α in the present invention is the repeating structural unit represented by the above-mentioned formula (A)-the repeating structural unit represented by the above-mentioned formula (B) copolymer. In addition, the form of copolymerization may be any form such as block copolymerization, random copolymerization, or alternating copolymerization.

From the viewpoint of forming the domain structure in the matrix including the above-mentioned components β and γ, the weight-average molecular weight of the polyester resin A which is used as the above-mentioned component α in the present invention is preferably not less than 30,000 and not more than 150,000, more preferably not less than 40,000 and not more than 100,000.

In the present invention, the weight-average molecular weight of the resin is a weight-average molecular weight in terms of polystyrene measured according to a conventional method by a method described in Japanese Patent Application Laid-Open No. 2007-79555.

The polyester resin A which is the above-mentioned component α in the present invention can be synthesized by, for example, a conventional phosgene method or transesterification method.

The charge-transporting layer which is the surface layer of the electrophotographic photosensitive member of the present invention may contain a resin having a siloxane structure in addition to the polyester resin A. Specific examples thereof include a polycarbonate resin having a siloxane structure, a polyester resin having a siloxane structure, and an acrylic resin having a siloxane structure. In the case of using another resin having a siloxane moiety, from the viewpoint of a balance between sustained reduction of contact stress and potential stability in repeated use, the content of the component α in the charge-transporting layer is preferably not less than 90% by mass and less than 100% by mass relative to the total mass of resins each having a siloxane moiety in the charge-transporting layer.

The content of the siloxane moiety in the polyester resin A of the present invention is preferably not less than 1% by mass and not more than 20% by mass relative to the total mass of whole resins in the charge-transporting layer. If the content of the siloxane moiety is not less than 1% by mass and not more than 20% by mass, the matrix-domain structure is formed stably, resulting in achieving the balance between sustained reduction of contact stress and potential stability in repeated use at high levels. Further, the content is more preferably not less than 2% by mass and not more than 10% by mass, which can further enhance the sustained reduction of contact stress and potential stability in repeated use.

Synthesis examples of the polyester resin A used as the component α in the present invention are shown below. The polyester resin A can be synthesized by synthesis methods described in Japanese Patent Application Laid-Open No. H05-043670 and Japanese Patent Application Laid-Open No. H08-234468. Also in the present invention, the polyester resins A shown in synthesis examples of Table 1 were synthesized using raw materials corresponding to the repeating structural unit represented by the formula (A) and the repeating structural unit represented by the formula (B) by the same synthesis methods. Table 1 shows the weight-average molecular weights of the synthesized polyester resins A and the siloxane moiety contents in the polyester resins A. Further, Table 1 shows Comparative Synthesis Example 1 (Resin E(1)) of a polyester resin A having a siloxane moiety content of 2% by mass and Comparative Synthesis Example 2 (Resin E(2)) of a polyester resin A having a siloxane moiety content of 50% by mass.

TABLE 1

| | Component [α] (Polyester resin A) | Repeating structural unit represented by formula (A): Repeating structural unit | W1 | Number of repetitions | Repeating structural unit represented by formula (B) | Terephthalic acid/ isophthalic acid ratio | Weight-average molecular weight (Mw) | Siloxane moiety content in polyester resin A (% by mass) |
|---|---|---|---|---|---|---|---|---|
| Synthesis Example 1 | Resin A(1) | (A-1) | (a-3) | n = 60 | (B-1) | 1/1 | 60,000 | 20 |
| Synthesis Example 2 | Resin A(2) | (A-2) | (a-3) | n = 60 | (B-1) | 1/1 | 60,000 | 20 |
| Synthesis Example 3 | Resin A(3) | (A-3) | (a-3) | n = 60 | (B-1) | 1/1 | 70,000 | 20 |
| Synthesis Example 4 | Resin A(4) | (A-4) | (a-3) | n = 60 | (B-1) | 1/1 | 50,000 | 20 |
| Synthesis Example 5 | Resin A(5) | (A-5) | (a-3) | n = 60 | (B-1) | 1/1 | 60,000 | 20 |
| Synthesis Example 6 | Resin A(6) | (A-6) | (a-3) | n = 60 | (B-1) | 3/7 | 80,000 | 20 |
| Synthesis Example 7 | Resin A(7) | (A-7) | (a-3) | n = 60 | (B-1) | 7/3 | 60,000 | 20 |
| Synthesis Example 8 | Resin A(8) | (A-8) | (a-3) | n = 60 | (B-11) | — | 50,000 | 20 |
| Synthesis Example 9 | Resin A(9) | (A-9) | (a-3) | n = 60 | (B-11) | — | 70,000 | 20 |
| Synthesis Example 10 | Resin A(10) | (A-10) | (a-3) | n = 60 | (B-12) | — | 60,000 | 20 |
| Synthesis Example 11 | Resin A(11) | (A-11) | (a-3) | n = 60 | (B-11) | — | 60,000 | 20 |
| Synthesis Example 12 | Resin A(12) | (A-12) | (a-3) | n = 60 | (B-11) | — | 50,000 | 20 |
| Synthesis Example 13 | Resin A(13) | (A-9) | (a-1) | n = 60 | (B-11) | — | 80,000 | 20 |
| Synthesis Example 14 | Resin A(14) | (A-1) | (a-1) | n = 60 | (B-1) | 1/1 | 50,000 | 20 |
| Synthesis Example 15 | Resin A(15) | (A-1) | (a-3) | n = 60 | (B-1) | 1/1 | 40,000 | 20 |
| Synthesis Example 16 | Resin A(16) | (A-1) | (a-3) | n = 60 | (B-1) | 1/1 | 90,000 | 20 |
| Synthesis Example 17 | Resin A(17) | (A-1) | (a-4) | n = 60 | (B-1) | 1/1 | 60,000 | 20 |
| Synthesis Example 18 | Resin A(18) | (A-1) | (b-2) | m = 30, k = 30 | (B-1) | 1/1 | 60,000 | 20 |
| Synthesis Example 19 | Resin A(19) | (A-1) | (a-3) | n = 60 | (B-1) | 1/1 | 70,000 | 5 |
| Synthesis Example 20 | Resin A(20) | (A-1) | (a-3) | n = 60 | (B-1) | 1/1 | 50,000 | 10 |
| Synthesis Example 21 | Resin A(21) | (A-1) | (a-3) | n = 60 | (B-1) | 1/1 | 60,000 | 30 |
| Synthesis Example 22 | Resin A(22) | (A-1) | (a-3) | n = 60 | (B-1) | 1/1 | 60,000 | 40 |
| Synthesis Example 23 | Resin A(23) | (A-1) | (a-3) | n = 60 | (B-2) | 1/1 | 60,000 | 20 |
| Synthesis Example 24 | Resin A(24) | (A-1) | (a-3) | n = 60 | (B-3) | 1/1 | 80,000 | 20 |
| Synthesis Example 25 | Resin A(25) | (A-1) | (a-3) | n = 60 | (B-4) | 1/1 | 60,000 | 20 |
| Synthesis Example 26 | Resin A(26) | (A-1) | (a-3) | n = 60 | (B-5) | 1/1 | 50,000 | 20 |
| Synthesis Example 27 | Resin A(27) | (A-1) | (a-3) | n = 60 | (B-6) | 1/1 | 60,000 | 20 |
| Synthesis Example 28 | Resin A(28) | (A-1) | (a-3) | n = 60 | (B-7) | 1/1 | 50,000 | 20 |
| Synthesis Example 29 | Resin A(29) | (A-1) | (a-3) | n = 60 | (B-8) | 1/1 | 60,000 | 20 |
| Synthesis Example 30 | Resin A(30) | (A-1) | (a-3) | n = 60 | (B-9) | 1/1 | 60,000 | 20 |
| Synthesis Example 31 | Resin A(31) | (A-8) | (a-3) | n = 60 | (B-10) | — | 80,000 | 20 |
| Synthesis Example 32 | Resin A(32) | (A-1) | (a-3) | n = 60 | (B-3)/(B-9) = 5/5 | 1/1 | 60,000 | 20 |
| Synthesis Example 33 | Resin A(33) | (A-1) | (a-3) | n = 10 | (B-1) | 1/1 | 70,000 | 20 |
| Synthesis Example 34 | Resin A(34) | (A-1) | (a-3) | n = 30 | (B-1) | 1/1 | 70,000 | 20 |
| Synthesis Example 35 | Resin A(35) | (A-1) | (a-3) | n = 40 | (B-1) | 1/1 | 60,000 | 20 |
| Synthesis Example 36 | Resin A(36) | (A-1) | (a-3) | n = 100 | (B-1) | 1/1 | 50,000 | 20 |

TABLE 1-continued

| | Component [α] (Polyester resin A) | Repeating structural unit represented by formula (A): Repeating structural unit | W1 | Number of repetitions | Repeating structural unit represented by formula (B) | Terephthalic acid/ isophthalic acid ratio | Weight-average molecular weight (Mw) | Siloxane moiety content in polyester resin A (% by mass) |
|---|---|---|---|---|---|---|---|---|
| Synthesis Example 37 | Resin A(37) | (A-1) | (a-3) | n = 150 | (B-1) | 1/1 | 60,000 | 20 |
| Synthesis Example 38 | Resin A(38) | (A-1) | (a-1) | n = 10 | (B-3)/(B-9) = 5/5 | 1/1 | 50,000 | 20 |
| Synthesis Example 39 | Resin A(39) | (A-1) | (a-1) | n = 40 | (B-3)/(B-9) = 5/5 | 1/1 | 60,000 | 20 |
| Synthesis Example 40 | Resin A(40) | (A-1) | (a-1) | n = 100 | (B-3)/(B-9) = 5/5 | 1/1 | 60,000 | 20 |
| Synthesis Example 41 | Resin A(41) | (A-1) | (a-1) | n = 150 | (B-3)/(B-9) = 5/5 | 1/1 | 60,000 | 20 |
| Synthesis Example 42 | Resin A(42) | (A-1) | (b-2) | m = 10, k = 10 | (B-1) | 1/1 | 70,000 | 25 |
| Synthesis Example 43 | Resin A(43) | (A-1) | (b-2) | m = 50, k = 50 | (B-1) | 1/1 | 60,000 | 25 |
| Synthesis Example 44 | Resin A(44) | (A-1) | (b-2) | m = 70, k = 70 | (B-1) | 1/1 | 60,000 | 25 |
| Synthesis Example 45 | Resin A(45) | (A-2) | (b-2) | m = 30, k = 30 | (B-1) | 3/7 | 50,000 | 25 |
| Synthesis Example 46 | Resin A(46) | (A-6) | (b-2) | m = 30, k = 30 | (B-1) | 7/3 | 60,000 | 25 |
| Synthesis Example 47 | Resin A(47) | (A-9) | (b-2) | m = 30, k = 30 | (B-11) | — | 50,000 | 25 |
| Synthesis Example 48 | Resin A(48) | (A-1) | (a-1) | n = 20 | (B-1) | 1/1 | 60,000 | 25 |
| Synthesis Example 49 | Resin A(49) | (A-2) | (a-1) | n = 30 | (B-2) | 1/1 | 60,000 | 30 |
| Synthesis Example 50 | Resin A(50) | (A-1) | (a-2) | n = 20 | (B-1) | 1/1 | 60,000 | 25 |
| Synthesis Example 51 | Resin A(51) | (A-1) | (b-1) | m = 40, k = 40 | (B-1) | 1/1 | 70,000 | 25 |
| Comparative Synthesis Example 1 | Resin E(1) | (A-1) | (a-3) | n = 60 | (B-1) | 1/1 | 70,000 | 2 |
| Comparative Synthesis Example 2 | Resin E(2) | (A-1) | (a-3) | n = 60 | (B-1) | 1/1 | 70,000 | 50 |

The term "Terephthalic acid/isophthalic acid ratio" in Table 1 refers to ratios of a terephthalic acid skeleton to an isophthalic acid skeleton in the specific examples of the repeating structural unit represented by the above-mentioned formula (A) "(A-1) to (A-7)" and the specific examples of the repeating structural unit represented by the above-mentioned formula (B) "(B-1) to (B-9)."

In Synthesis Example (Resin A(1)), the maximum value and the minimum value of the number of repetitions "n" of the structure within brackets represented by the above-mentioned formula (a) were 63 and 57, respectively. In Synthesis Example (Resin A(18)), the maximum value and the minimum value of the sum (m+k) of the numbers of repetitions "m" and "k" of the structures within brackets represented by the above-mentioned formula (b) were 64 and 56, respectively.

<Component β>

The component β of the present invention is at least one resin selected from the group consisting of a polycarbonate resin C having a repeating structural unit represented by the following formula (C) and a polyester resin D having a repeating structural unit represented by the following formula (D).

(C)

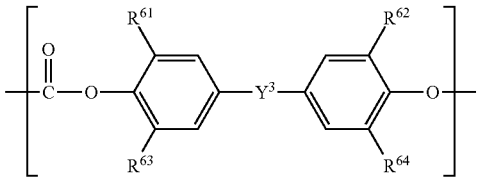

In the formula (C), $R^{61}$ to $R^{64}$ each independently represents a hydrogen atom or a methyl group. $Y^3$ represents a single bond, a methylene group, an ethylidene group, a propylidene group, a phenylethylidene group, a cyclohexylidene group, or an oxygen atom.

(D)

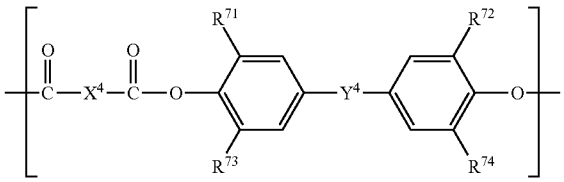

In the formula (D), $R^{71}$ to $R^{74}$ each independently represents a hydrogen atom, or a methyl group. $X^4$ represents a meta-phenylene group, a para-phenylene group, or a bivalent group having two para-phenylene groups bonded with an oxygen atom. $Y^4$ represents a single bond, a methylene group, an ethylidene group, a propylidene group, a cyclohexylidene group, or an oxygen atom.

Specific examples of the repeating structural unit represented by the above-mentioned formula (C) are shown below.

(C-1)

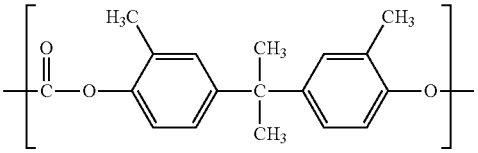

(C-2)

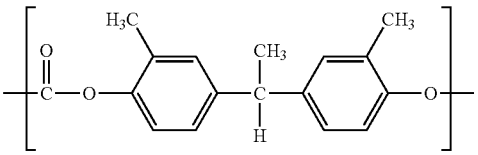

(C-3)

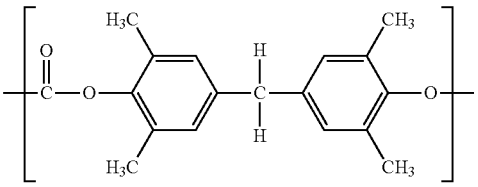

(C-4)

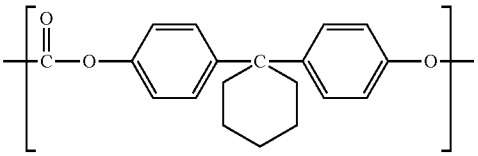

-continued (C-5)

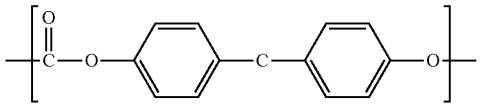

(C-6)

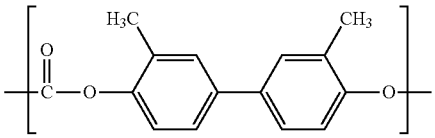

(C-7)

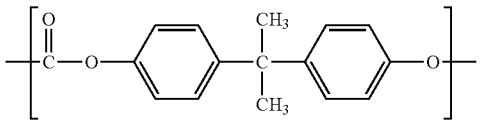

(C-8)

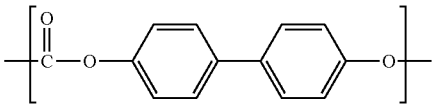

(C-9)

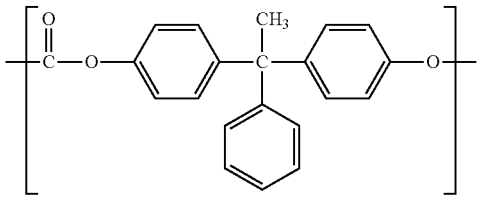

Of those, the repeating structural unit represented by the above-mentioned formula (C-1), (C-2), (C-3), (C-7), or (C-9) is preferred.

Specific examples of the repeating structural unit represented by the above-mentioned formula (D) are shown below.

(D-1)

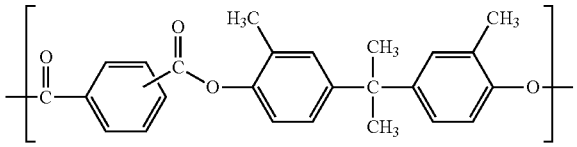

(D-2)

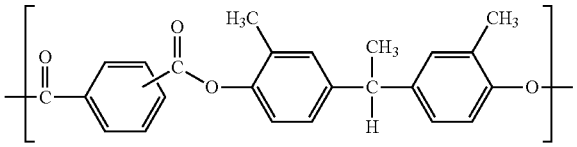

(D-3)

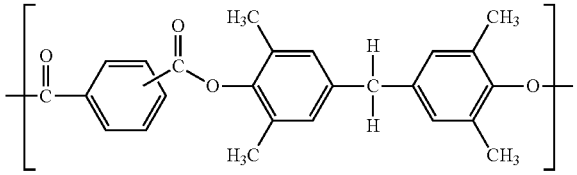

(D-4)

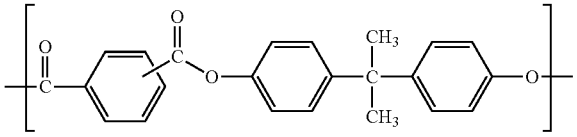

(D-5)

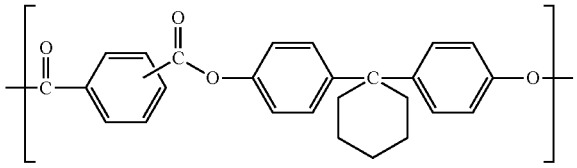

(D-6)

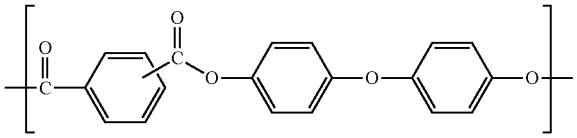

-continued (D-7)

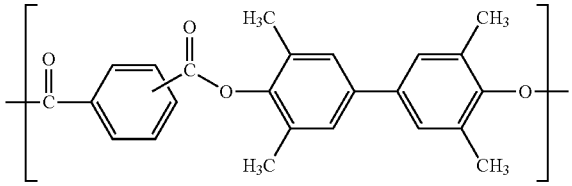

(D-8)

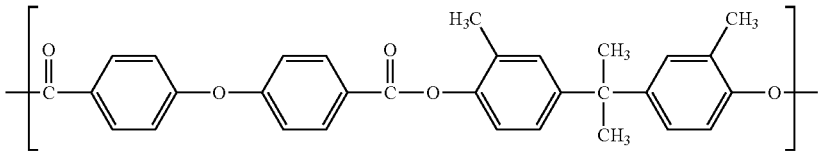

(D-9)

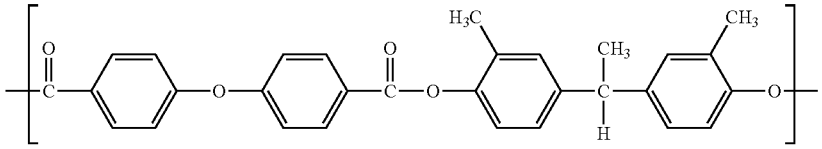

(D-10)

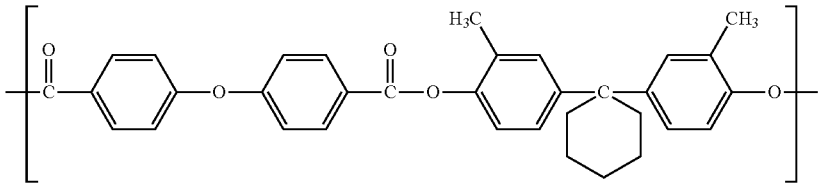

Of those, the repeating structural unit represented by the above-mentioned formula (D-3), (D-4), (D-8), or (D-9) is preferred.

The charge-transporting layer which is the surface layer of the electrophotographic photosensitive member of the present invention contains the components α and β as resins, and an additional resin may be mixed therein. Examples of the additional resin which may be mixed include an acrylic resin, a polyester resin, and a polycarbonate resin. In the case where the additional resin is mixed, the ratio of the component β (polycarbonate resin C or polyester resin D) to the additional resin is preferably in a range in which the content of the component β is not less than 90% by mass and less than 100% by mass (mass ratio). In the present invention, in the case where the additional resin is mixed in addition to the component β, from the viewpoint of forming a uniform matrix with the charge-transporting substance, the additional resin preferably has no siloxane structure.

The charge-transporting layer which is the surface layer of the electrophotographic photosensitive member of the present invention contains the component γ as the charge-transporting substance, and may contain a charge-transporting substance having another structure. Examples of the charge-transporting substance having another structure include a triarylamine compound and a hydrazone compound. Of those, use of the triarylamine compound as the charge-transporting substance is preferred in terms of potential stability in repeated use. In the case where a charge-transporting substance having another structure is mixed, the component γ is contained at a content of preferably 50% by mass or more, more preferably 70% by mass or more in whole charge-transporting substances in the charge-transporting layer.

Next, the construction of the electrophotographic photosensitive member of the present invention is described.

The electrophotographic photosensitive member of the present invention has a conductive support, a charge-generating layer which is provided on the conductive support and comprises a charge-generating substance, and a charge-transporting layer which is provided on the charge-generating layer, comprises a charge-transporting substance. Further, in the electrophotographic photosensitive member, the charge-transporting layer is a surface layer (outermost layer) of the electrophotographic photosensitive member.

Further, the charge-transporting layer of the electrophotographic photosensitive member of the present invention includes the above-mentioned components α, β, and γ.

Further, the charge-transporting layer may have a laminate structure, and in such case, the layer is formed so that at least the charge-transporting layer provided on the outermost surface has the above-mentioned matrix-domain structure.

In general, as the electrophotographic photosensitive member, a cylindrical electrophotographic photosensitive member produced by forming a photosensitive layer (charge-generating layer or charge-transporting layer) on a cylindrical conductive support is widely used, but the member may have a formed of belt or sheet.

[Conductive Support]

The conductive support to be used in the electrophotographic photosensitive member of the present invention is preferably conductive (conductive support) and is, for example, one made of aluminum, an aluminum alloy, or stainless steel. In the case of aluminum or an aluminum alloy, the conductive support used may be an ED tube or an EI tube or one obtained by subjecting the ED tube or the EI tube to cutting, electrolytic composite polish, or a wet- or dry-honing process. Further examples thereof include a conductive support made of a metal or a resin having formed thereon a thin film of a conductive material such as aluminum, an aluminum alloy, or an indium oxide-tin oxide alloy. The surface of the support may be subjected to, for example, cutting treatment, roughening treatment, or alumite treatment.

In addition, a conductive support obtained by impregnating conductive particles such as carbon black, tin oxide particles, titanium oxide particles, or silver particles in a resin or the like, or a plastic including a conductive binder resin may be used.

[Conductive Layer]

In the electrophotographic photosensitive member of the present invention, a conductive layer having conductive particles and a resin may be provided on the support. In a method of forming a conductive layer having conductive particles and a resin on a support, powder containing the conductive particles is contained in the conductive layer. Examples of the conductive particles include carbon black, acetylene black, metal powders made of, for example, aluminum, nickel, iron, nichrome, copper, zinc, and silver, and metal oxide powders made of, for example, conductive tin oxide and ITO.

Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin. Those resins may be used each alone or in combination of two or more kinds thereof.

Examples of a solvent used as a conductive-layer coating solution include an ether-based solvent, an alcohol-based solvent, a ketone-based solvent, and an aromatic hydrocarbon solvent. The film thickness of the conductive layer is preferably 0.2 μm or more to 40 μm or less, more preferably 1 μm or more to 35 μm or less, still more preferably 5 μm or more to 30 μm or less.

[Intermediate Layer]

The electrophotographic photosensitive member of the present invention may include an intermediate layer between the conductive support or the conductive layer and the charge-generating layer.

The intermediate layer can be formed by applying an intermediate-layer coating solution containing a resin on the support or the conductive layer and drying or hardening the coating solution.

Examples of the resin to be used in the intermediate layer include polyacrylic acids, methylcellulose, ethylcellulose, a polyamide resin, a polyimide resin, a polyamideimide resin, a polyamide acid resin, a melamine resin, an epoxy resin, and a polyurethane resin. The resin to be used in the intermediate layer is preferably a thermoplastic resin, and specifically, a thermoplastic polyamide resin is preferred. Examples of the polyamide resin include copolymer nylon with low crystallinity or amorphous which can be applied in solution state.

The film thickness of the intermediate layer is preferably 0.05 μm or more to 40 μm or less, more preferably 0.1 μm or more to 20 μm or less. The intermediate layer may further contain a semiconductive particle, an electron-transporting substance, or an electron-accepting substance.

[Charge-Generating Layer]

In the electrophotographic photosensitive member of the present invention, the charge-generating layer is provided on the conductive support, conductive layer, or intermediate layer.

Examples of the charge-generating substance to be used in the electrophotographic photosensitive member of the present invention include azo pigments, phthalocyanine pigments, indigo pigments, and perylene pigments. Only one kind of those charge-generating substances may be used, or two or more kinds thereof may be used. Of those, oxytitanium phthalocyanine, hydroxygallium phthalocyanine, and chlorogallium phthalocyanine are particularly preferred because of their high sensitivity.

Examples of the resin to be used in the charge-generating layer include a polycarbonate resin, a polyester resin, a butyral resin, a polyvinyl acetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge-generating layer can be formed by applying a charge-generating-layer coating solution, which is prepared by dispersing a charge-generating substance together with a resin and a solvent, and then drying the coating solution. Further, the charge-generating layer may also be a deposited film of a charge-generating substance.

Examples of the dispersion method include those using a homogenizer, an ultrasonic wave, a ball mill, a sand mill, an attritor, or a roll mill.

A ratio between the charge-generating substance and the resin is preferably 0.1 part by mass or more to 10 parts by mass or less, particularly preferably 1 part by mass or more to 3 parts by mass or less of the charge-generating substance with respect to 1 part by mass of the resin.

Examples of the solvent to be used in the charge-generating-layer coating solution include an alcohol-based solvent, a sulfoxide-based solvent, a ketone-based solvent, an ether-based solvent, an ester-based solvent, and an aromatic hydrocarbon solvent.

The film thickness of the charge-generating layer is preferably 0.01 μm or more to 5 μm or less, more preferably 0.1 μm or more to 2 μm or less. Further, the charge-generating layer may be added with any of various sensitizers, antioxidants, UV absorbents, plasticizers, and the like if required. A charge-transporting substance or a charge-accepting substance may also be added to the charge-generating layer to prevent the flow of charge from being disrupted in the charge-generating layer.

[Charge-Transporting Layer]

In the electrophotographic photosensitive member of the present invention, the charge-transporting layer is provided on the charge-generating layer.

The charge-transporting layer which is the surface layer of the electrophotographic photosensitive member of the present invention contains the component γ as a specific charge-transporting substance, and may also contain a charge-transporting substance having another structure as described above. The charge-transporting substance which has another structure and may be mixed is as described above.

The charge-transporting layer which is the surface layer of the electrophotographic photosensitive member of the present invention contains the components α and β as resins, but as described above, another resin may further be mixed. The resin which may be mixed is as described above.

The charge-transporting layer can be formed by applying a charge-transporting-layer coating solution obtained by dissolving a charge-transporting substance and the above-mentioned resins into a solvent and then drying the coating solution.

A ratio between the charge-transporting substance and the resins is preferably 0.4 part by mass or more to 2 parts by mass or less, more preferably 0.5 part by mass or more to 1.2 parts by mass or less of the charge-transporting substance with respect to 1 part by mass of the resins.

Examples of the solvent to be used for the charge-transporting-layer coating solution include ketone-based solvents, ester-based solvents, ether-based solvents, and aromatic hydrocarbon solvents. Those solvents may be used each alone or as a mixture of two or more kinds thereof. Of those solvents, it is preferred to use any of the ether-based solvents and the aromatic hydrocarbon solvents from the viewpoint of resin solubility.

The charge-transporting layer has a film thickness of preferably 5 μm or more to 50 μm or less, more preferably 10 μm or more to 35 μm or less. In addition, the charge-transporting layer may be added with an antioxidant, a UV absorber, or a plasticizer if required.

A variety of additives may be added to each layer of the electrophotographic photosensitive member of the present invention. Examples of the additives include: a deterioration-preventing agent such as an antioxidant, a UV absorber, or a light stabilizer; and fine particles such as organic fine particles or inorganic fine particles. Examples of the deterioration-preventing agent include a hindered phenol-based antioxidant, a hindered amine-based light stabilizer, a sulfur atom-containing antioxidant, and a phosphorus atom-containing antioxidant. Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the coating solutions corresponding to the above-mentioned respective layers, any of the application methods can be employed, such as dip coating, spraying coating, spinner coating, roller coating, Mayer bar coating, and blade coating.

[Electrophotographic Apparatus]

FIGURE illustrates an example of the schematic construction of an electrophotographic apparatus including a process cartridge including the electrophotographic photosensitive member of the present invention.

In FIGURE, a cylindrical electrophotographic photosensitive member 1 can be driven to rotate around an axis 2 in the direction indicated by the arrow at a predetermined peripheral speed. The surface of the rotated electrophotographic photosensitive member 1 is uniformly charged in negative at predetermined potential by a charging device (primary charging device: such as a charging roller) 3 during the process of rotation. Subsequently, the surface of the electrophotographic photosensitive member 1 receives exposure light (image exposure light) 4 which is emitted from an exposing device (not shown) such as a slit exposure or a laser-beam scanning exposure and which is intensity-modulated according to a time-series electric digital image signal of image information of purpose. In this way, electrostatic latent images corresponding to the image information of purpose are sequentially formed on the surface of the electrophotographic photosensitive member 1.

The electrostatic latent images formed on the surface of the electrophotographic photosensitive member 1 are converted into toner images by reversal development with toner included in a developer of a developing device 5. Subsequently, the toner images being formed and held on the surface of the electrophotographic photosensitive member 1 are sequentially transferred to a transfer material (such as paper) P by a transfer bias from a transferring device (such as transfer roller) 6. It should be noted that the transfer material P is taken from a transfer material supplying device (not shown) in synchronization with the rotation of the electrophotographic photosensitive member 1 and fed to a portion (contact part) between the electrophotographic photosensitive member 1 and the transferring device 6. Further, bias voltage having a polarity reverse to that of the electric charges the toner has is applied to the transferring device 6 from a bias power source (not shown).

The transfer material P which has received the transfer of the toner images is dissociated from the surface of the electrophotographic photosensitive member 1 and then introduced to a fixing device 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the remaining developer (remaining toner) after the transfer by a cleaning device (such as cleaning blade) 7. Subsequently, the surface of the electrophotographic photosensitive member 1 is subjected to a neutralization process with pre-exposure light (not shown) from a pre-exposing device (not shown) and then repeatedly used in image formation. As shown in FIGURE, further, when the charging device 3 is a contact-charging device using a charging roller, the pre-exposure is not always required.

In the present invention, of the constituents including the electrophotographic photosensitive member 1, the charging device 3, the developing device 5, the transferring device 6, and the cleaning device 7 as described above, a plurality of them may be selected and housed in a container and then integrally supported as a process cartridge. In addition, the process cartridge may be designed so as to be detachably mounted on the main body of an electrophotographic apparatus such as a copying machine or a laser beam printer. In FIGURE, the electrophotographic photosensitive member 1, the charging device 3, the developing device 5, and the cleaning device 7 are integrally supported and placed in a cartridge, thereby forming a process cartridge 9. The process cartridge 9 is detachably mounted on the main body of the electrophotographic apparatus using a guiding device 10 such as a rail of the main body of the electrophotographic apparatus.

EXAMPLES

Hereinafter, the present invention is described in more detail with reference to examples and comparative examples. However, the present invention is not limited in any way to the following examples. In addition, "part(s)" means "part(s) by mass" in the examples.

Example 1

An aluminum cylinder with a diameter of 30 mm and a length of 260.5 mm was used as a conductive support. Next, 10 parts of $SnO_2$-coated barium sulfate (conductive particle), 2 parts of titanium oxide (pigment for controlling resistance), 6 parts of a phenol resin (binder resin), and 0.001 part of silicone oil (leveling agent) were used together with a mixed solvent of 4 parts of methanol and 16 parts of methoxypropanol, to thereby prepare a conductive-layer coating solution. The conductive-layer coating solution was applied on the above-mentioned aluminum cylinder by dip coating and cured (thermally-cured) at 140° C. for 30 minutes, to thereby form a conductive layer with a film thickness of 15 μm.

Next, 3 parts of N-methoxymethylated nylon and 3 parts of copolymer nylon were dissolved in a mixed solvent of 65 parts of methanol and 30 parts of n-butanol, to thereby prepare an intermediate-layer coating solution. The intermediate-layer coating solution was applied on the above-mentioned conductive layer by dip coating and dried at 100° C. for 10 minutes, to thereby form an intermediate layer with a film thickness of 0.7 μm.

Next, 10 parts of hydroxygallium phthalocyanine crystal (charge-generating substance) having a crystal structure showing intense peaks at Bragg angles (2θ±0.2°) of 7.5°, 9.9°, 16.3°, 18.6°, 25.1°, and 28.3° in CuKα characteristic X-ray diffraction were prepared. To the crystal were added 250 parts of cyclohexanone and 5 parts of a polyvinyl butyral resin (product name: S-LEC BX-1, manufactured by Sekisui Chemical Co., Ltd.), and the resultant mixture was dispersed by a sand mill apparatus using glass beads with a diameter of 1 mm under a 23±3° C. atmosphere for 1 hour. After the dispersion, 250 parts of ethyl acetate were added to prepare a charge-generating-layer coating solution. The charge-generating-layer coating solution was applied on the above-mentioned intermediate layer by dip coating and dried at 100° C. for 10 minutes, to thereby form a charge-generating layer with a film thickness of 0.26 μm.

Next, 10 parts of a charge-transporting substance having the structure represented by the above-mentioned formula (1-3) as the component γ, 4 parts of the polyester resin A(1) synthesized in Synthesis Example 1 as the component α, and 6 parts of a polycarbonate resin C (weight-average molecular weight: 120,000) including the repeating structure represented by the formula (C-1) and the repeating structure represented by the formula (C-7) described above at a ratio of 8:2 as the component β were dissolved in a mixed solvent of 20 parts of tetrahydrofuran and 60 parts of toluene, to thereby prepare a charge-transporting-layer coating solution. The charge-transporting-layer coating solution was applied on the above-mentioned charge-generating layer by dip coating and dried at 110° C. for 1 hour, to thereby form a charge-transporting layer with a film thickness of 16 μm. It was confirmed that the resultant charge-transporting layer contained a domain including the component α in a matrix including the components β and γ.

Thus, an electrophotographic photosensitive member including the charge-transporting layer as the surface layer was prepared. Table 2 shows the components α, β, and γ in the resultant charge-transporting layer, the content of the siloxane moiety in the polyester resin A (siloxane content A), and the content of the siloxane moiety in the polyester resin A relative to the total mass of whole resins in the charge-transporting layer (siloxane content B).

Next, evaluation is described.

Evaluation was performed for a variation (potential variation) of bright section potentials in repeated use of 2,000 sheets of paper, torque relative values in early time and in repeated use of 2,000 sheets of paper, and observation of the surface of the electrophotographic photosensitive member in measurement of the torques.

A laser beam printer LBP-2510 manufactured by Canon Inc. (charging (primary charging): contact-charging mode, process speed: 94.2 mm/s), modified so as to adjust a charge potential (dark section potential) of the electrophotographic photosensitive member, was used as an evaluation apparatus. Further, a cleaning blade made of polyurethane rubber was set so as to have a contact angle of 25° and a contact pressure of 35 g/cm$^2$ relative to the surface of the electrophotographic photosensitive member. Evaluation was performed under an environment of a temperature of 23° C. and a relative humidity of 50%.

<Evaluation of Potential Variation>

The exposure amount (image exposure amount) of a 780-nm laser light source used as an evaluation apparatus was set so that the light intensity on the surface of the electrophotographic photosensitive member was 0.3 μJ/cm$^2$. Measurement of the potentials (dark section potential and bright section potential) of the surface of the electrophotographic photosensitive member was performed at a position of a developing device after replacing the developing device by a fixture fixed so that a probe for potential measurement was located at a position of 130 mm from the end of the electrophotographic photosensitive member. The dark section potential at an unexposed part of the electrophotographic photosensitive member was set to −450 V, laser light was irradiated, and the bright section potential obtained by light attenuation from the dark section potential was measured. Further, A4-size plain paper was used to continuously output 2,000 images, and variations of the bright section potentials before and after the output were evaluated. A test chart having a printing ratio of 5% was used. The results are shown in the column "Potential variation" in Table 7.

<Evaluation of Torque Relative Value>

A driving current (current A) of a rotary motor of the electrophotographic photosensitive member was measured under the same conditions as those in the evaluation of the potential variation described above. This evaluation was performed for evaluating an amount of contact stress between the electrophotographic photosensitive member and the cleaning blade. The resultant current shows how large the amount of contact stress between the electrophotographic photosensitive member and the cleaning blade is.

Moreover, an electrophotographic photosensitive member for comparison of a torque relative value was produced by the following method. The electrophotographic photosensitive member was prepared in the same manner as in Example 1 except that the polyester resin A(1) which is the component α used in the charge-transporting layer of the electrophotographic photosensitive member of Example 1 was replaced by the component β in Table 2, and only the component β was used as the resin. The resultant electrophotographic photosensitive member was used as the electrophotographic photosensitive member for comparison.

The resultant electrophotographic photosensitive member for comparison was used to measure a driving current (current B) of a rotary motor of the electrophotographic photosensitive member in the same manner as in Example 1.

A ratio of the driving current (current A) of the rotary motor of the electrophotographic photosensitive member containing the component α according to the present invention to the driving current (current B) of the rotary motor of the electrophotographic photosensitive member not containing the component α was calculated. The resultant value of (current A)/(current B) was compared as a torque relative value. The torque relative value represents a degree of reduction in the contact stress between the electrophotographic photosensitive member and the cleaning blade by use of the component α. As the torque relative value becomes smaller, the degree of reduction in the contact stress between the electrophotographic photosensitive member and the cleaning blade becomes larger. The results are shown in the column "Initial torque relative value" in Table 7.

Subsequently, A4-size plain paper was used to continuously output 2,000 images. A test chart having a printing ratio of 5% was used. After that, measurement of torque relative values after repeated use of 2,000 sheets was performed. The torque relative value after repeated use of 2,000 sheets of the paper were used in a repetitive manner for the electrophotographic photosensitive member for comparison, and the resultant driving current of the rotary motor was used to calculate the torque relative value after repeated use of 2,000 sheets of paper. The results are shown in the column "Torque relative value after repeated use of 2,000 sheets of paper" in Table 7.

<Evaluation of Matrix-Domain Structure>

The cross-sectional surface of the charge-transporting layer, obtained by cutting the charge-transporting layer in a vertical direction with respect to the electrophotographic photosensitive member produced by the above-mentioned method, was observed using an ultradeep profile measurement microscope VK-9500 (manufactured by KEYENCE CORPORATION). In this process, an area of 100 μm×100 μm (10,000 $\mu m^2$) in the surface of the electrophotographic photosensitive member was defined as a visual field and observed at an object lens magnification of 50× to measure the maximum diameter of 100 formed domains selected at random in the visual field. An average was calculated from the maximum diameter and provided as a number average particle size. Table 7 shows the results.

Examples 2 to 104

Electrophotographic photosensitive members were produced in the same manner as in Example 1 except that the components α, β, and γ in the charge-transporting layers were replaced as shown in Tables 2 to 4, and evaluated. It was confirmed that each of the resultant charge-transporting layers contains a domain including the component α in a matrix including the components β and [γ]. Tables 7 and 8 show the results.

It should be noted that the weight-average molecular weight of the polycarbonate resin C used as the component β were found to be as follows.

(C-1)/(C-7)=8/2: 120,000

(C-2)/(C-4)=5/5: 130,000

(C-3)/(C-7)=8/2: 100,000

(C-5)/(C-8)=8/2: 120,000

(C-4)/(C-9)=5/5: 90,000

(C-4)/(C-5)=5/5: 150,000

(C-1)/(C-9)=5/5: 130,000

Examples 105 to 108

Electrophotographic photosensitive members were produced in the same manner as in Example 1 except that the components α, β, and γ in the charge-transporting layers were replaced as shown in Table 4, and evaluated. It was confirmed that each of the resultant charge-transporting layers contains a domain including the component α in a matrix including the components β and γ. Table 8 shows the results. It should be noted that a charge-transporting substance having the structure represented by one of the following formulae (3-1) and (3-2) was mixed as the charge-transporting substance with a charge-transporting substance which is the component γ and has the structure represented by one of the above-mentioned formulae (1) and (1').

(3-1)

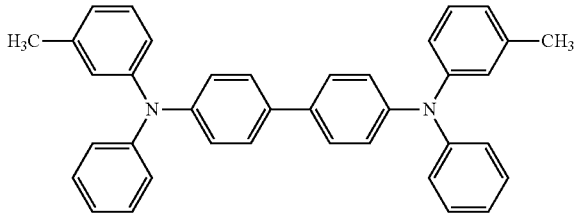

(3-2)

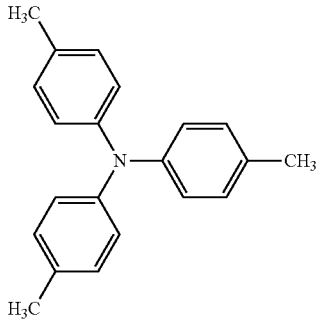

In addition, the weight-average molecular weight of the polycarbonate resin C used as the component β was found to be as follows.

(C-1)/(C-9)=5/5: 130,000.

Examples 109 to 194

Electrophotographic photosensitive members were produced in the same manner as in Example 1 except that the components α, β, and γ in the charge-transporting layers were replaced as shown in Tables 4 and 5, and evaluated. It was confirmed that each of the resultant charge-transporting layers contains a domain including the component α in a matrix including the components β and γ. Table 8 shows the results.

In addition, the weight-average molecular weight of the polyester resin D used as the component β were found to be as follows.

(D-3)/(D-4)=7/3: 150,000

(D-3)/(D-7)=7/3: 130,000

(D-9): 120,000

(D-4)/(D-5)=1/9: 100,000

(D-1)/(D-2)=5/5: 120,000

(D-8)/(D-10)=7/3: 110,000

(D-6)/(D-7)=5/5: 130,000.

Further, the repeating structural units represented by the above-mentioned formulae (D-1), (D-2), (D-3), (D-4), (D-5), (D-6), and (D-7) each have a terephthalic acid skeleton/isophthalic acid skeleton ratio of 1/1.

Comparative Examples 1 to 16

Electrophotographic photosensitive members were prepared in the same manner as in Example 1 except that the polyester resin A(1) was replaced by a polyester resin E(1) of Comparative Synthesis Example 1 shown in Table 1, and modifications were made as shown in Table 6. Evaluation was performed in the same manner as in Example 1, and Table 9 shows the results. The resultant charge-transporting layers were found to have no matrix-domain structure.

Comparative Example 17

An electrophotographic photosensitive member was prepared in the same manner as in Example 1 except that only the above-mentioned polyester resin E(1) was used as the resin in the charge-transporting layer. Evaluation was performed in the same manner as in Example 1, and Table 9 shows the results. The resultant charge-transporting layer was found to have no matrix-domain structure. It should be noted that the electrophotographic photosensitive member for comparison used in Example 1 was used as an electrophotographic photosensitive member for comparison of a torque relative value.

Comparative Examples 18 to 29

Electrophotographic photosensitive members were prepared in the same manner as in Example 1 except that the polyester resin A(1) was replaced by a polyester resin E(2) of Comparative Synthesis Example 2 shown in Table 1, and modifications were made as shown in Table 6. Evaluation was performed in the same manner as in Example 1, and Table 9 shows the results. The resultant charge-transporting layers were each found to have a matrix-domain structure.

Comparative Example 30

An electrophotographic photosensitive member was prepared in the same manner as in Example 1 except that only the above-mentioned polyester resin E(2) was used as the resin in the charge-transporting layer. Evaluation was performed in the same manner as in Example 1, and Table 9 shows the results. The resultant charge-transporting layer was found to have no matrix-domain structure. It should be noted that the electrophotographic photosensitive member for comparison used in Example 1 was used as an electrophotographic photosensitive member for comparison of a torque relative value.

Comparative Examples 31 to 36

Electrophotographic photosensitive members were prepared in the same manner as in Example 1 except that, in Example 1, the polyester resin A(1) were replaced to a polyester resin (E(3): weight-average molecular weight: 60,000) containing a repeating structural unit represented by the following formula (E-3) which is a structure described in Patent Literature 1 and a repeating structural unit represented by the above-mentioned formula (B-1) and having a siloxane moiety content of 30% by mass in the polyester resin, and modifications were made as shown in Table 6. The repeating structural units represented by the formula (E-3) and (B-1) each have a terephthalic acid skeleton/isophthalic acid skeleton ratio of 1/1. Evaluation was performed in the same manner as in Example 1, and Table 9 shows the results. The resultant charge-transporting layers were each found to have a matrix-domain structure. It should be noted that the electrophotographic photosensitive member for comparison used in Example 188 was used as an electrophotographic photosensitive member for comparison of a torque relative value. It should be noted that the numerical value representing the number of repetitions of the siloxane moiety in the repeating structural unit represented by the following formula (E-3) shows the average of the numbers of repetitions. In this case, the average of the numbers of repetitions of the siloxane moiety in the repeating structural unit represented by the following formula (E-3) in the resin E(3) is 40.

(E-3)

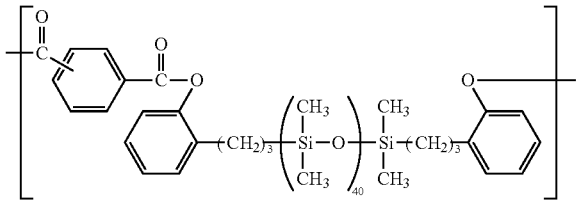

Comparative Example 37

An electrophotographic photosensitive member was prepared in the same manner as in Example 63 except that, Example 63, the polyester resin A(2) was replaced to a polycarbonate resin (E(4): weight-average molecular weight: 80,000) containing a repeating structural unit represented by the following formula (E-4) and a repeating structural unit represented by the above-mentioned formula (C-2) and having a siloxane moiety content of 30% by mass in the polycarbonate resin. Table 9 shows the results. The resultant charge-transporting layer was found to have no matrix-domain structure. It should be noted that the numerical value representing the number of repetitions of the siloxane moiety in the repeating structural unit represented by the following formula (E-4) shows the average of the numbers of repetitions. In this case, the average of the numbers of repetitions of the siloxane moiety in the repeating structural unit represented by the following formula (E-4) in the resin E(4) is 20.

(E-4)

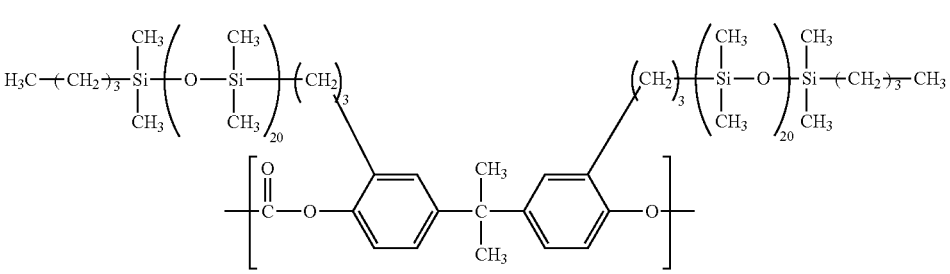

Comparative Examples 38 to 40

Electrophotographic photosensitive members were produced in the same manner as in Example 114 except that the polyester resin A(1) was replaced by the above-mentioned polycarbonate resin E(4), and modifications were made as shown in Table 6. Table 9 shows the results. The resultant charge-transporting layers were found to have no matrix-domain structure.

Comparative Examples 41 to 44

Electrophotographic photosensitive members were prepared in the same manner as in Example 1 except that the polyester resin A(1) was replaced by the above-mentioned resin E(3), the charge-transporting substance was replaced by the substance represented by the above-mentioned formula (3-1), and modifications were made as shown in Table 6. Evaluation was performed in the same manner as in Example 1, and Table 9 shows the results. The resultant charge-transporting layers were each found to have a matrix-domain structure. It should be noted that the electrophotographic photosensitive member for comparison used in Example 188 was used as an electrophotographic photosensitive member for comparison of a torque relative value.

Comparative Examples 45 and 46

Electrophotographic photosensitive members were prepared in the same manner as in Example 1 except that the polyester resin A(1) was replaced by the polyester resin A(21), the charge-transporting substance was replaced by the substance represented by the above-mentioned formula (3-1), and modifications were made as shown in Table 6. Evaluation was performed in the same manner as in Example 1, and Table 9 shows the results. The resultant charge-transporting layers were each found to have a matrix-domain structure. It should be noted that the electrophotographic photosensitive member for comparison used in Example 144 was used as an electrophotographic photosensitive member for comparison of a torque relative value.

TABLE 2

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 1 | (1-3) | Resin A(1) | 20 | (C-1)/(C-7) = 8/2 | 4/6 | 8 |
| Example 2 | (1-3) | Resin A(1) | 20 | (C-1)/(C-7) = 8/2 | 2/8 | 4 |
| Example 3 | (1-3) | Resin A(1) | 20 | (C-1)/(C-7) = 8/2 | 5/5 | 10 |
| Example 4 | (1-3) | Resin A(2) | 20 | (C-1)/(C-7) = 8/2 | 4/6 | 8 |
| Example 5 | (1-3) | Resin A(2) | 20 | (C-1)/(C-7) = 8/2 | 2/8 | 4 |
| Example 6 | (1-3) | Resin A(2) | 20 | (C-1)/(C-7) = 8/2 | 5/5 | 10 |
| Example 7 | (1-3) | Resin A(3) | 20 | (C-1)/(C-7) = 8/2 | 4/6 | 8 |
| Example 8 | (1-3) | Resin A(4) | 20 | (C-1)/(C-7) = 8/2 | 4/6 | 8 |
| Example 9 | (1-3) | Resin A(5) | 20 | (C-1)/(C-7) = 8/2 | 4/6 | 8 |
| Example 10 | (1-3) | Resin A(6) | 20 | (C-1)/(C-7) = 8/2 | 4/6 | 8 |
| Example 11 | (1-3) | Resin A(7) | 20 | (C-1)/(C-7) = 8/2 | 4/6 | 8 |
| Example 12 | (1-3) | Resin A(8) | 20 | (C-1)/(C-7) = 8/2 | 4/6 | 8 |
| Example 13 | (1-3) | Resin A(9) | 20 | (C-1)/(C-7) = 8/2 | 4/6 | 8 |
| Example 14 | (1-3) | Resin A(10) | 20 | (C-1)/(C-7) = 8/2 | 4/6 | 8 |
| Example 15 | (1-3) | Resin A(11) | 20 | (C-1)/(C-7) = 8/2 | 4/6 | 8 |
| Example 16 | (1-3) | Resin A(12) | 20 | (C-1)/(C-7) = 8/2 | 4/6 | 8 |
| Example 17 | (1-3) | Resin A(13) | 20 | (C-1)/(C-7) = 8/2 | 4/6 | 8 |
| Example 18 | (1-3) | Resin A(14) | 20 | (C-1)/(C-7) = 8/2 | 4/6 | 8 |
| Example 19 | (1-3) | Resin A(15) | 20 | (C-1)/(C-7) = 8/2 | 4/6 | 8 |
| Example 20 | (1-3) | Resin A(16) | 20 | (C-1)/(C-7) = 8/2 | 4/6 | 8 |
| Example 21 | (1-3) | Resin A(17) | 20 | (C-1)/(C-7) = 8/2 | 4/6 | 8 |
| Example 22 | (1-3) | Resin A(18) | 20 | (C-1)/(C-7) = 8/2 | 4/6 | 8 |
| Example 23 | (1-3) | Resin A(19) | 5 | (C-1)/(C-7) = 8/2 | 4/6 | 2 |
| Example 24 | (1-3) | Resin A(19) | 5 | (C-1)/(C-7) = 8/2 | 2/8 | 1 |
| Example 25 | (1-3) | Resin A(20) | 10 | (C-1)/(C-7) = 8/2 | 4/6 | 4 |
| Example 26 | (1-3) | Resin A(21) | 30 | (C-1)/(C-7) = 8/2 | 4/6 | 12 |

TABLE 2-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 27 | (1-3) | Resin A(22) | 40 | (C-1)/(C-7) = 8/2 | 4/6 | 16 |
| Example 28 | (1-3) | Resin A(22) | 40 | (C-1)/(C-7) = 8/2 | 5/5 | 20 |
| Example 29 | (1-3) | Resin A(23) | 20 | (C-1)/(C-7) = 8/2 | 4/6 | 8 |
| Example 30 | (1-3) | Resin A(24) | 20 | (C-1)/(C-7) = 8/2 | 4/6 | 8 |
| Example 31 | (1-3) | Resin A(25) | 20 | (C-1)/(C-7) = 8/2 | 4/6 | 8 |
| Example 32 | (1-3) | Resin A(26) | 20 | (C-1)/(C-7) = 8/2 | 4/6 | 8 |
| Example 33 | (1-3) | Resin A(27) | 20 | (C-1)/(C-7) = 8/2 | 4/6 | 8 |
| Example 34 | (1-3) | Resin A(28) | 20 | (C-1)/(C-7) = 8/2 | 4/6 | 8 |
| Example 35 | (1-3) | Resin A(29) | 20 | (C-1)/(C-7) = 8/2 | 4/6 | 8 |
| Example 36 | (1-3) | Resin A(30) | 20 | (C-1)/(C-7) = 8/2 | 4/6 | 8 |
| Example 37 | (1-3) | Resin A(31) | 20 | (C-1)/(C-7) = 8/2 | 4/6 | 8 |
| Example 38 | (1-3) | Resin A(32) | 20 | (C-1)/(C-7) = 8/2 | 4/6 | 8 |
| Example 39 | (1-3) | Resin A(33) | 20 | (C-1)/(C-7) = 8/2 | 4/6 | 8 |
| Example 40 | (1-3) | Resin A(34) | 20 | (C-1)/(C-7) = 8/2 | 4/6 | 8 |
| Example 41 | (1-3) | Resin A(35) | 20 | (C-1)/(C-7) = 8/2 | 4/6 | 8 |
| Example 42 | (1-3) | Resin A(36) | 20 | (C-1)/(C-7) = 8/2 | 4/6 | 8 |
| Example 43 | (1-3) | Resin A(37) | 20 | (C-1)/(C-7) = 8/2 | 4/6 | 8 |
| Example 44 | (1-3) | Resin A(38) | 20 | (C-1)/(C-7) = 8/2 | 4/6 | 8 |
| Example 45 | (1-3) | Resin A(39) | 20 | (C-1)/(C-7) = 8/2 | 4/6 | 8 |

The term "Component [γ]" in Tables 2 to 6 refers to the above-mentioned component γ in the charge-transporting layer. In the case of using a mixture of charge-transporting substances, the term refers to the types and mixing ratio of the component γ and another charge-transporting substance. The term "Component [α]" in Tables 2 to 6 refers to the composition of the above-mentioned component α. The term "Siloxane content A (% by mass)" in Tables 2 to 6 refers to the content (% by mass) of the siloxane moiety in the polyester resin A. The term "Component [β]" in Tables 2 to 6 refers to the composition of the above-mentioned component β. The term "Mixing ratio of component [α] to component [β]" in Tables 2 to 6 refers to the mixing ratio (component α/component β) of the above-mentioned component α to the above-mentioned component β in the charge-transporting layer. The term "Siloxane content B (% by mass)" in Tables 2 to 6 refers to the content (% by mass) of the siloxane moiety in the polyester resin A relative to the total mass of resins in the charge-transporting layer.

TABLE 3

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 46 | (1-3) | Resin A(40) | 20 | (C-1)/(C-7) = 8/2 | 4/6 | 8 |
| Example 47 | (1-3) | Resin A(41) | 20 | (C-1)/(C-7) = 8/2 | 4/6 | 8 |
| Example 48 | (1-3) | Resin A(42) | 25 | (C-1)/(C-7) = 8/2 | 4/6 | 10 |
| Example 49 | (1-3) | Resin A(43) | 25 | (C-1)/(C-7) = 8/2 | 4/6 | 10 |
| Example 50 | (1-3) | Resin A(44) | 25 | (C-1)/(C-7) = 8/2 | 4/6 | 10 |
| Example 51 | (1-3) | Resin A(45) | 25 | (C-1)/(C-7) = 8/2 | 4/6 | 10 |
| Example 52 | (1-3) | Resin A(46) | 25 | (C-1)/(C-7) = 8/2 | 4/6 | 10 |

TABLE 3-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 53 | (1-3) | Resin A(47) | 25 | (C-1)/(C-7) = 8/2 | 4/6 | 10 |
| Example 54 | (1-3) | Resin A(48) | 25 | (C-1)/(C-7) = 8/2 | 4/6 | 10 |
| Example 55 | (1-3) | Resin A(49) | 30 | (C-1)/(C-7) = 8/2 | 4/6 | 12 |
| Example 56 | (1-3) | Resin A(50) | 25 | (C-1)/(C-7) = 8/2 | 4/6 | 10 |
| Example 57 | (1-3) | Resin A(51) | 25 | (C-1)/(C-7) = 8/2 | 4/6 | 10 |
| Example 58 | (1-3) | Resin A(1) | 20 | (C-2)/(C-4) = 5/5 | 3/7 | 6 |
| Example 59 | (1-3) | Resin A(1) | 20 | (C-3)/(C-7) = 8/2 | 3/7 | 6 |
| Example 60 | (1-3) | Resin A(1) | 20 | (C-5)/(C-6) = 8/2 | 3/7 | 6 |
| Example 61 | (1-3) | Resin A(1) | 20 | (C-5)/(C-8) = 8/2 | 3/7 | 6 |
| Example 62 | (1-3) | Resin A(2) | 20 | (C-2)/(C-4) = 5/5 | 2/8 | 4 |
| Example 63 | (1-3) | Resin A(2) | 20 | (C-3)/(C-7) = 8/2 | 4/6 | 8 |
| Example 64 | (1-3) | Resin A(2) | 20 | (C-5)/(C-6) = 8/2 | 3/7 | 6 |
| Example 65 | (1-3) | Resin A(2) | 20 | (C-5)/(C-8) = 8/2 | 2/8 | 4 |
| Example 66 | (1-3) | Resin A(49) | 30 | (C-2)/(C-4) = 5/5 | 4/6 | 12 |
| Example 67 | (1-3) | Resin A(49) | 30 | (C-3)/(C-7) = 8/2 | 4/6 | 12 |
| Example 68 | (1-3) | Resin A(49) | 30 | (C-5)/(C-6) = 8/2 | 4/6 | 12 |
| Example 69 | (1-3) | Resin A(49) | 30 | (C-5)/(C-8) = 8/2 | 4/6 | 12 |
| Example 70 | (1-3) | Resin A(32) | 20 | (C-2)/(C-4) = 5/5 | 4/6 | 8 |
| Example 71 | (1-3) | Resin A(32) | 20 | (C-3)/(C-7) = 8/2 | 4/6 | 8 |
| Example 72 | (1-3) | Resin A(32) | 20 | (C-5)/(C-6) = 8/2 | 4/6 | 8 |
| Example 73 | (1-3) | Resin A(32) | 20 | (C-5)/(C-8) = 8/2 | 4/6 | 8 |
| Example 74 | (2-1) | Resin A(19) | 5 | (C-4)/(C-9) = 5/5 | 2/8 | 1 |
| Example 75 | (2-1) | Resin A(19) | 5 | (C-4)/(C-9) = 5/5 | 4/6 | 2 |
| Example 76 | (2-1) | Resin A(20) | 10 | (C-4)/(C-9) = 5/5 | 4/6 | 4 |
| Example 77 | (2-1) | Resin A(21) | 30 | (C-4)/(C-9) = 5/5 | 4/6 | 12 |
| Example 78 | (2-1) | Resin A(22) | 40 | (C-4)/(C-9) = 5/5 | 3/7 | 12 |
| Example 79 | (2-1) | Resin A(22) | 40 | (C-4)/(C-9) = 5/5 | 5/5 | 20 |
| Example 80 | (1-1)/(1-2) = 5/5 | Resin A(1) | 20 | (C-1)/(C-7) = 8/2 | 4/6 | 8 |
| Example 81 | (1-4)/(1-5) = 5/5 | Resin A(1) | 20 | (C-1)/(C-7) = 8/2 | 4/6 | 8 |
| Example 82 | (1-6)/(1-7) = 5/5 | Resin A(1) | 20 | (C-1)/(C-7) = 8/2 | 4/6 | 8 |
| Example 83 | (1-8) | Resin A(1) | 20 | (C-1)/(C-7) = 8/2 | 4/6 | 8 |
| Example 84 | (1-9)/(1-10) = 5/5 | Resin A(1) | 20 | (C-1)/(C-7) = 8/2 | 4/6 | 8 |
| Example 85 | (1-8)/(1-11) = 3/7 | Resin A(1) | 20 | (C-1)/(C-7) = 8/2 | 4/6 | 8 |
| Example 86 | (2-1) | Resin A(1) | 20 | (C-1)/(C-7) = 8/2 | 4/6 | 8 |
| Example 87 | (2-2)/(2-3) = 5/5 | Resin A(1) | 20 | (C-1)/(C-7) = 8/2 | 4/6 | 8 |
| Example 88 | (1-11) | Resin A(1) | 20 | (C-4)/(C-5) = 5/5 | 4/6 | 8 |
| Example 89 | (1-9)/(1-10) = 5/5 | Resin A(2) | 20 | (C-4)/(C-5) = 5/5 | 4/6 | 8 |

TABLE 3-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 90 | (1-9)/(1-10) = 5/5 | Resin A(23) | 20 | (C-4)/(C-5) = 5/5 | 4/6 | 8 |
| Example 91 | (2-5) | Resin A(19) | 5 | (C-4)/(C-9) = 5/5 | 2/8 | 1 |
| Example 92 | (2-5) | Resin A(20) | 10 | (C-4)/(C-9) = 5/5 | 4/6 | 4 |
| Example 93 | (2-5) | Resin A(21) | 30 | (C-4)/(C-9) = 5/5 | 4/6 | 12 |
| Example 94 | (2-5) | Resin A(22) | 40 | (C-4)/(C-9) = 5/5 | 5/5 | 20 |

TABLE 4

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 95 | (1-9)/(1-10) = 5/5 | Resin A(32) | 20 | (C-4)/(C-5) = 5/5 | 4/6 | 8 |
| Example 96 | (1-9)/(1-10) = 5/5 | Resin A(39) | 20 | (C-4)/(C-5) = 5/5 | 4/6 | 8 |
| Example 97 | (1-9)/(1-10) = 5/5 | Resin A(49) | 30 | (C-4)/(C-5) = 5/5 | 4/6 | 12 |
| Example 98 | (2-2)/(2-3) = 5/5 | Resin A(27) | 20 | (C-4)/(C-5) = 5/5 | 4/6 | 8 |
| Example 99 | (2-1) | Resin A(2) | 20 | (C-4)/(C-5) = 5/5 | 4/6 | 8 |
| Example 100 | (2-1) | Resin A(23) | 20 | (C-4)/(C-5) = 5/5 | 4/6 | 8 |
| Example 101 | (2-1) | Resin A(32) | 20 | (C-4)/(C-5) = 5/5 | 4/6 | 8 |
| Example 102 | (2-1) | Resin A(39) | 20 | (C-4)/(C-5) = 5/5 | 4/6 | 8 |
| Example 103 | (2-1) | Resin A(49) | 30 | (C-4)/(C-5) = 5/5 | 4/6 | 12 |
| Example 104 | (2-1) | Resin A(1) | 20 | (C-1)/(C-9) = 5/5 | 4/6 | 8 |
| Example 105 | (1-3)/(3-1) = 8/2 | Resin A(1) | 20 | (C-1)/(C-9) = 5/5 | 4/6 | 8 |
| Example 106 | (1-3)/(3-2) = 8/2 | Resin A(1) | 20 | (C-1)/(C-9) = 5/5 | 4/6 | 8 |
| Example 107 | (1-11)/(3-1) = 8/2 | Resin A(1) | 20 | (C-1)/(C-9) = 5/5 | 4/6 | 8 |
| Example 108 | (1-8)/(3-2) = 8/2 | Resin A(1) | 20 | (C-1)/(C-9) = 5/5 | 4/6 | 8 |
| Example 109 | (1-1)/(1-2) = 5/5 | Resin A(1) | 20 | (D-3)/(D-4) = 7/3 | 4/6 | 8 |
| Example 110 | (1-4)/(1-5) = 5/5 | Resin A(1) | 20 | (D-3)/(D-4) = 7/3 | 4/6 | 8 |
| Example 111 | (1-6)/(1-7) = 5/5 | Resin A(1) | 20 | (D-3)/(D-4) = 7/3 | 4/6 | 8 |
| Example 112 | (1-8) | Resin A(1) | 20 | (D-3)/(D-4) = 7/3 | 4/6 | 8 |
| Example 113 | (1-9)/(1-10) = 5/5 | Resin A(1) | 20 | (D-3)/(D-4) = 7/3 | 4/6 | 8 |
| Example 114 | (1-8)/(1-11) = 3/7 | Resin A(1) | 20 | (D-3)/(D-4) = 7/3 | 4/6 | 8 |
| Example 115 | (2-1) | Resin A(1) | 20 | (D-3)/(D-4) = 7/3 | 4/6 | 8 |
| Example 116 | (1-1)/(1-2) = 5/5 | Resin A(1) | 20 | (D-3)/(D-7) = 7/3 | 4/6 | 8 |
| Example 117 | (1-4)/(1-5) = 5/5 | Resin A(1) | 20 | (D-3)/(D-7) = 7/3 | 4/6 | 8 |
| Example 118 | (1-6)/(1-7) = 5/5 | Resin A(1) | 20 | (D-3)/(D-7) = 7/3 | 4/6 | 8 |
| Example 119 | (1-8) | Resin A(1) | 20 | (D-3)/(D-7) = 7/3 | 4/6 | 8 |
| Example 120 | (1-9)/(1-10) = 5/5 | Resin A(1) | 20 | (D-3)/(D-7) = 7/3 | 4/6 | 8 |
| Example 121 | (1-8)/(1-11) = 3/7 | Resin A(1) | 20 | (D-3)/(D-7) = 7/3 | 4/6 | 8 |

TABLE 4-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 122 | (2-1) | Resin A(1) | 20 | (D-3)/(D-7) = 7/3 | 4/6 | 8 |
| Example 123 | (2-1) | Resin A(2) | 20 | (D-3)/(D-7) = 7/3 | 4/6 | 8 |
| Example 124 | (2-1) | Resin A(3) | 20 | (D-3)/(D-7) = 7/3 | 4/6 | 8 |
| Example 125 | (2-1) | Resin A(4) | 20 | (D-3)/(D-7) = 7/3 | 4/6 | 8 |
| Example 126 | (2-1) | Resin A(5) | 20 | (D-3)/(D-7) = 7/3 | 4/6 | 8 |
| Example 127 | (2-1) | Resin A(6) | 20 | (D-3)/(D-7) = 7/3 | 4/6 | 8 |
| Example 128 | (2-1) | Resin A(7) | 20 | (D-3)/(D-7) = 7/3 | 4/6 | 8 |
| Example 129 | (2-1) | Resin A(8) | 20 | (D-3)/(D-7) = 7/3 | 4/6 | 8 |
| Example 130 | (2-1) | Resin A(9) | 20 | (D-3)/(D-7) = 7/3 | 4/6 | 8 |
| Example 131 | (2-1) | Resin A(10) | 20 | (D-3)/(D-7) = 7/3 | 4/6 | 8 |
| Example 132 | (2-1) | Resin A(11) | 20 | (D-3)/(D-7) = 7/3 | 4/6 | 8 |
| Example 133 | (2-1) | Resin A(12) | 20 | (D-3)/(D-7) = 7/3 | 4/6 | 8 |
| Example 134 | (2-1) | Resin A(13) | 20 | (D-3)/(D-7) = 7/3 | 4/6 | 8 |
| Example 135 | (2-1) | Resin A(14) | 20 | (D-3)/(D-7) = 7/3 | 4/6 | 8 |
| Example 136 | (2-1) | Resin A(15) | 20 | (D-3)/(D-7) = 7/3 | 4/6 | 8 |
| Example 137 | (2-1) | Resin A(16) | 20 | (D-3)/(D-7) = 7/3 | 4/6 | 8 |
| Example 138 | (2-1) | Resin A(17) | 20 | (D-3)/(D-7) = 7/3 | 4/6 | 8 |
| Example 139 | (2-1) | Resin A(18) | 20 | (D-3)/(D-7) = 7/3 | 4/6 | 8 |
| Example 140 | (2-4) | Resin A(1) | 20 | (D-3)/(D-4) = 7/3 | 4/6 | 8 |
| Example 141 | (2-5) | Resin A(1) | 20 | (D-3)/(D-4) = 7/3 | 4/6 | 8 |
| Example 142 | (2-5) | Resin A(2) | 20 | (D-3)/(D-4) = 7/3 | 4/6 | 8 |
| Example 143 | (2-6) | Resin A(1) | 20 | (D-3)/(D-4) = 7/3 | 4/6 | 8 |

TABLE 5

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 144 | (2-1) | Resin A(19) | 5 | (D-3)/(D-7) = 7/3 | 4/6 | 2 |
| Example 145 | (2-1) | Resin A(20) | 10 | (D-3)/(D-7) = 7/3 | 4/6 | 4 |
| Example 146 | (2-1) | Resin A(21) | 30 | (D-3)/(D-7) = 7/3 | 4/6 | 12 |
| Example 147 | (2-1) | Resin A(22) | 40 | (D-3)/(D-7) = 7/3 | 4/6 | 16 |
| Example 148 | (2-1) | Resin A(23) | 20 | (D-3)/(D-7) = 7/3 | 4/6 | 8 |
| Example 149 | (2-1) | Resin A(24) | 20 | (D-3)/(D-7) = 7/3 | 4/6 | 8 |
| Example 150 | (2-1) | Resin A(25) | 20 | (D-3)/(D-7) = 7/3 | 4/6 | 8 |
| Example 151 | (2-1) | Resin A(26) | 20 | (D-3)/(D-7) = 7/3 | 4/6 | 8 |
| Example 152 | (2-1) | Resin A(27) | 20 | (D-3)/(D-7) = 7/3 | 4/6 | 8 |
| Example 153 | (2-1) | Resin A(28) | 20 | (D-3)/(D-7) = 7/3 | 4/6 | 8 |

TABLE 5-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 154 | (2-1) | Resin A(29) | 20 | (D-3)/(D-7) = 7/3 | 4/6 | 8 |
| Example 155 | (2-1) | Resin A(30) | 20 | (D-3)/(D-7) = 7/3 | 4/6 | 8 |
| Example 156 | (2-1) | Resin A(31) | 20 | (D-3)/(D-7) = 7/3 | 4/6 | 8 |
| Example 157 | (2-1) | Resin A(32) | 20 | (D-3)/(D-7) = 7/3 | 4/6 | 8 |
| Example 158 | (2-1) | Resin A(33) | 20 | (D-3)/(D-7) = 7/3 | 4/6 | 8 |
| Example 159 | (2-1) | Resin A(34) | 20 | (D-3)/(D-7) = 7/3 | 4/6 | 8 |
| Example 160 | (2-1) | Resin A(35) | 20 | (D-3)/(D-7) = 7/3 | 4/6 | 8 |
| Example 161 | (2-1) | Resin A(36) | 20 | (D-3)/(D-7) = 7/3 | 4/6 | 8 |
| Example 162 | (2-1) | Resin A(37) | 20 | (D-3)/(D-7) = 7/3 | 4/6 | 8 |
| Example 163 | (2-1) | Resin A(38) | 20 | (D-3)/(D-7) = 7/3 | 4/6 | 8 |
| Example 164 | (2-1) | Resin A(39) | 20 | (D-3)/(D-7) = 7/3 | 4/6 | 8 |
| Example 165 | (2-1) | Resin A(40) | 20 | (D-3)/(D-7) = 7/3 | 4/6 | 8 |
| Example 166 | (2-1) | Resin A(41) | 20 | (D-3)/(D-7) = 7/3 | 4/6 | 8 |
| Example 167 | (2-1) | Resin A(42) | 25 | (D-3)/(D-7) = 7/3 | 4/6 | 10 |
| Example 168 | (2-1) | Resin A(43) | 25 | (D-3)/(D-7) = 7/3 | 4/6 | 10 |
| Example 169 | (2-1) | Resin A(44) | 25 | (D-3)/(D-7) = 7/3 | 4/6 | 10 |
| Example 170 | (2-1) | Resin A(45) | 25 | (D-3)/(D-7) = 7/3 | 4/6 | 10 |
| Example 171 | (2-1) | Resin A(46) | 25 | (D-3)/(D-7) = 7/3 | 4/6 | 10 |
| Example 172 | (2-1) | Resin A(47) | 25 | (D-3)/(D-7) = 7/3 | 4/6 | 10 |
| Example 173 | (2-1) | Resin A(48) | 25 | (D-3)/(D-7) = 7/3 | 4/6 | 10 |
| Example 174 | (2-1) | Resin A(49) | 30 | (D-3)/(D-7) = 7/3 | 4/6 | 12 |
| Example 175 | (2-1) | Resin A(50) | 25 | (D-3)/(D-7) = 7/3 | 4/6 | 10 |
| Example 176 | (2-1) | Resin A(51) | 25 | (D-3)/(D-7) = 7/3 | 4/6 | 10 |
| Example 177 | (2-1) | Resin A(2) | 20 | (D-9) | 4/6 | 8 |
| Example 178 | (2-1) | Resin A(19) | 5 | (D-9) | 4/6 | 2 |
| Example 179 | (2-1) | Resin A(22) | 40 | (D-9) | 4/6 | 16 |
| Example 180 | (2-1) | Resin A(23) | 20 | (D-9) | 4/6 | 8 |
| Example 181 | (2-1) | Resin A(32) | 20 | (D-9) | 4/6 | 8 |
| Example 182 | (2-1) | Resin A(39) | 20 | (D-9) | 4/6 | 8 |
| Example 1 83 | (2-1) | Resin A(49) | 30 | (D-9) | 4/6 | 12 |
| Example 184 | (2-1) | Resin (1) | 20 | (D-4)/(D-5) = 1/9 | 4/6 | 8 |
| Example 185 | (2-1) | Resin (1) | 20 | (D-1)/(D-2) = 5/5 | 4/6 | 8 |
| Example 186 | (2-1) | Resin (1) | 20 | (D-8)/(D-10) = 7/3 | 4/6 | 8 |
| Example 187 | (2-1) | Resin (1) | 20 | (D-6)/(D-7) = 5/5 | 4/6 | 8 |
| Example 1 88 | (2-1) | Resin (1) | 20 | (D-1) | 3/7 | 6 |
| Example 1 89 | (1-3) | Resin (1) | 20 | (D-1) | 3/7 | 6 |
| Example 190 | (1-8)/(1-11) = 3/7 | Resin (1) | 20 | (D-1) | 3/7 | 6 |

TABLE 5-continued

| | Component [Y] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 1 91 | (2-5) | Resin A(21) | 30 | (D-1) | 3/7 | 9 |
| Example 192 | (2-5) | Resin A(2) | 20 | (D-9) | 4/6 | 8 |
| Example 93 | (2-5) | Resin A(19) | 5 | (D-9) | 4/6 | 2 |
| Example 1 94 | (2-5) | Resin A(22) | 40 | (D-9) | 4/6 | 16 |

TABLE 6

| | Charge-trans-porting substance | Resin E | Siloxane content A (% by mass) | Component [β] | Mixing ratio of resin E to component [β] | Siloxane content B (% by mass) |
|---|---|---|---|---|---|---|
| Comparative Example 1 | (1-3) | Resin E(1) | 2 | (C-1)/(C-7) = 8/2 | 3/7 | 0.6 |
| Comparative Example 2 | (1-1)/(1-2) = 5/5 | Resin E(1) | 2 | (C-1)/(C-7) = 8/2 | 4/6 | 0.8 |
| Comparative Example 3 | (1-4)/(1-5) = 5/5 | Resin E(1) | 2 | (C-1)/(C-7) = 8/2 | 4/6 | 0.8 |
| Comparative Example 4 | (1-6)/(1-7) = 5/5 | Resin E(1) | 2 | (C-1)/(C-7) = 8/2 | 4/6 | 0.8 |
| Comparative Example 5 | (2-1) | Resin E(1) | 2 | (C-4)/(C-9) = 5/5 | 4/6 | 0.8 |
| Comparative Example 6 | (1-3) | Resin E(1) | 2 | (C-2)/(C-4) = 5/5 | 3/7 | 0.6 |
| Comparative Example 7 | (1-3) | Resin E(1) | 2 | (C-3)/(C-7) = 8/2 | 3/7 | 0.6 |
| Comparative Example 8 | (1-3) | Resin E(1) | 2 | (C-5)/(C-6) = 8/2 | 3/7 | 0.6 |
| Comparative Example 9 | (1-3) | Resin E(1) | 2 | (C-5)/(C-) 8) = 8/2 | 3/7 | 0.6 |
| Comparative Example 10 | (1-3)/(3-1) = 8/2 | Resin E(1) | 2 | (C-1)/C-9) = 5/5 | 4/6 | 0.8 |
| Comparative Example 11 | (1-3) | Resin E(1) | 2 | (C-1)/(C-7) = 8/2 | 5/5 | 1 |
| Comparative Example 12 | (2-1) | Resin E(1) | 2 | (C-4)/(C-9) = 5/5 | 5/5 | 1 |
| Comparative Example 13 | (1-4)/(1-5) = 5/5 | Resin E(1) | 2 | (D-3)/(D-4) = 7/3 | 4/6 | 0.8 |
| Comparative Example 14 | (1-6)/(1-7) = 5/5 | Resin E(1) | 2 | (D-3)/(D-4) = 7/3 | 4/6 | 0.8 |
| Comparative Example 15 | (1-8)/(1-11) = 3/7 | Resin E(1) | 2 | (D-3)/(D-4) = 7/3 | 4/6 | 0.8 |
| Comparative Example 16 | (2-1) | Resin E(1) | 2 | (D-3)/(D-4) = 7/3 | 4/6 | 0.8 |
| Comparative Example 17 | (1-3) | Resin E(1) | 2 | — | — | 2 |
| Comparative Example 18 | (1-3) | Resin E(2) | 50 | (C-1)/(C-7) = 8/2 | 3/7 | 15 |
| Comparative Example 19 | (1-1)/(1-2) = 5/5 | Resin E(2) | 50 | (C-1)/(C-7) = 8/2 | 3/7 | 15 |
| Comparative Example 20 | (1-4)/(1-5) = 5/5 | Resin E(2) | 50 | (C-1)/(C-7) = 8/2 | 3/7 | 15 |
| Comparative Example 21 | (1-6)/(1-7) = 5/5 | Resin E(2) | 50 | (C-1)/(C-7) = 8/2 | 3/7 | 15 |
| Comparative Example 22 | (2-1) | Resin E(2) | 50 | (C-4)/(C-9) = 5/5 | 3/7 | 15 |
| Comparative Example 23 | (2-1) | Resin E(2) | 50 | (D-3)/(D-4) = 7/3 | 3/7 | 15 |
| Comparative Example 24 | (1-3) | Resin E(2) | 50 | (C-1)/(C-7) = 8/2 | 1/9 | 5 |
| Comparative Example 25 | (1-1)/(1-2) = 5/5 | Resin E(2) | 50 | (C-1)/(C-7) = 8/2 | 1/9 | 5 |
| Comparative Example 26 | (1-4)/(1-5) = 5/5 | Resin E(2) | 50 | (C-1)/(C-7) = 8/2 | 1/9 | 5 |
| Comparative Example 27 | (1-6)/(1-7) = 5/5 | Resin E(2) | 50 | (C-1)/(C-7) = 8/2 | 1/9 | 5 |
| Comparative Example 28 | (2-1) | Resin E(2) | 50 | (C-4)/(C-9) = 5/5 | 1/9 | 5 |

TABLE 6-continued

| | Charge-trans-porting substance | Resin E | Siloxane content A (% by mass) | Component [β] | Mixing ratio of resin E to component [β] | Siloxane content B (% by mass) |
|---|---|---|---|---|---|---|
| Comparative Example 29 | (2-1) | Resin E(2) | 50 | (D-3)/(D-4) = 7/3 | 1/9 | 5 |
| Comparative Example 30 | (1-3) | Resin E(2) | 50 | — | — | 50 |
| Comparative Example 31 | (1-3) | Resin E(3) | 30 | (D-1) | 3/7 | 9 |
| Comparative Example 32 | (1-1)/(1-2) = 5/5 | Resin E(3) | 30 | (D-1) | 3/7 | 9 |
| Comparative Example 33 | (1-4)/(1-5) = 5/5 | Resin E(3) | 30 | (D-1) | 3/7 | 9 |
| Comparative Example 34 | (1-6)/(1-7) = 5/5 | Resin E(3) | 30 | (D-1) | 3/7 | 9 |
| Comparative Example 35 | (2-1) | Resin E(3) | 30 | (D-1) | 3/7 | 9 |
| Comparative Example 36 | (2-5) | Resin E(3) | 30 | (D-1) | 3/7 | 9 |
| Comparative Example 37 | (1-3) | Resin E(4) | 30 | (C-3)/(C-7) = 8/2 | 3/7 | 9 |
| Comparative Example 38 | (1-8)/(1-11) = 3/7 | Resin E(4) | 30 | (D-3)/(D-4) = 7/3 | 4/6 | 12 |
| Comparative Example 39 | (2-1) | Resin E(4) | 30 | (D-3)/(D-4) = 7/3 | 4/6 | 12 |
| Comparative Example 40 | (2-5) | Resin E(4) | 30 | (D-3)/(D-4) = 7/3 | 4/6 | 12 |
| Comparative Example 41 | (3-1) | Resin E(3) | 30 | (C-1)/(C-7) = 8/2 | 3/7 | 9 |
| Comparative Example 42 | (3-1) | Resin E(3) | 30 | (C-3)/(C-7) = 8/2 | 3/7 | 9 |
| Comparative Example 43 | (3-1) | Resin E(3) | 30 | (C-2)/(C-4) = 5/5 | 3/7 | 9 |
| Comparative Example 44 | (3-1) | Resin E(3) | 30 | (D-3)/(D-4) = 7/3 | 3/7 | 9 |
| Comparative Example 45 | (3-1) | Resin A(21) | 30 | (C-3)/(C-7) = 8/2 | 3/7 | 9 |
| Comparative Example 46 | (3-1) | Resin A(21 | 30 | (D-3)/(D-4) = 7/3 | 3/7 | 9 |

The term "Charge-transporting substance" in Table 6 refers to the charge-transporting substance in the charge-transporting layer of the present invention. In the case of using a mixture of charge-transporting substances, the term refers to the types and mixing ratio of the charge-transporting substances. The term "Resin E" in Table 6 refers to the resin E having the siloxane moiety. The term "Siloxane content A (% by mass)" in Table 6 refers to the content (% by mass) of the siloxane moiety in the "Resin E" or "Resin A." The term "Component [β]" in Table 6 refers to the composition of the above-mentioned component β. The term "Mixing ratio of resin E to component [β]" in Table 6 refers to the mixing ratio (resin E or resin A/component β) of the polycarbonate resin E or the resin A to the above-mentioned component β in the charge-transporting layer. The term "Siloxane content B (% by mass)" in Table 6 refers to the content (% by mass) of the siloxane moiety in the "Resin E" relative to the total mass of whole resins in the charge-transporting layer.

Tables 7 to 9 below show the results of evaluation in Examples 1 to 194 and Comparative Examples 1 to 46.

TABLE 7

| | Potential variation (V) | Initial torque relative value | Torque relative value after repeated use of 2,000 sheets of paper | Particle size (nm) |
|---|---|---|---|---|
| Example 1 | 5 | 0.63 | 0.67 | 450 |
| Example 2 | 5 | 0.71 | 0.75 | 330 |
| Example 3 | 5 | 0.61 | 0.65 | 580 |

TABLE 7-continued

| | Potential variation (V) | Initial torque relative value | Torque relative value after repeated use of 2,000 sheets of paper | Particle size (nm) |
|---|---|---|---|---|
| Example 4 | 5 | 0.64 | 0.68 | 440 |
| Example 5 | 5 | 0.72 | 0.76 | 320 |
| Example 6 | 5 | 0.62 | 0.66 | 570 |
| Example 7 | 5 | 0.65 | 0.69 | 460 |
| Example 8 | 5 | 0.65 | 0.69 | 460 |
| Example 9 | 5 | 0.65 | 0.69 | 460 |
| Example 10 | 5 | 0.66 | 0.70 | 460 |
| Example 11 | 5 | 0.65 | 0.69 | 460 |
| Example 12 | 5 | 0.65 | 0.69 | 460 |
| Example 13 | 5 | 0.65 | 0.69 | 460 |
| Example 14 | 5 | 0.66 | 0.70 | 460 |
| Example 15 | 5 | 0.65 | 0.69 | 460 |
| Example 16 | 5 | 0.65 | 0.69 | 460 |
| Example 17 | 5 | 0.65 | 0.69 | 450 |
| Example 18 | 5 | 0.64 | 0.68 | 460 |
| Example 19 | 5 | 0.67 | 0.71 | 460 |
| Example 20 | 5 | 0.64 | 0.68 | 460 |
| Example 21 | 5 | 0.65 | 0.69 | 460 |
| Example 22 | 5 | 0.64 | 0.68 | 460 |
| Example 23 | 5 | 0.74 | 0.78 | 280 |
| Example 24 | 5 | 0.77 | 0.81 | 180 |
| Example 25 | 5 | 0.68 | 0.72 | 330 |
| Example 26 | 5 | 0.63 | 0.67 | 500 |
| Example 27 | 8 | 0.62 | 0.66 | 550 |
| Example 28 | 13 | 0.61 | 0.65 | 750 |
| Example 29 | 5 | 0.65 | 0.69 | 460 |
| Example 30 | 5 | 0.65 | 0.69 | 460 |
| Example 31 | 5 | 0.65 | 0.69 | 470 |

TABLE 7-continued

| | Potential variation (V) | Initial torque relative value | Torque relative value after repeated use of 2,000 sheets of paper | Particle size (nm) |
|---|---|---|---|---|
| Example 32 | 5 | 0.65 | 0.69 | 460 |
| Example 33 | 5 | 0.65 | 0.69 | 460 |
| Example 34 | 5 | 0.65 | 0.69 | 460 |
| Example 35 | 5 | 0.65 | 0.69 | 450 |
| Example 36 | 5 | 0.65 | 0.69 | 460 |
| Example 37 | 5 | 0.65 | 0.69 | 460 |
| Example 38 | 5 | 0.65 | 0.69 | 460 |
| Example 39 | 5 | 0.65 | 0.69 | 460 |
| Example 40 | 5 | 0.65 | 0.69 | 460 |
| Example 41 | 5 | 0.65 | 0.69 | 460 |
| Example 42 | 5 | 0.65 | 0.69 | 460 |
| Example 43 | 5 | 0.65 | 0.69 | 470 |
| Example 44 | 5 | 0.65 | 0.69 | 460 |
| Example 45 | 5 | 0.65 | 0.69 | 460 |
| Example 46 | 5 | 0.65 | 0.69 | 460 |
| Example 47 | 5 | 0.65 | 0.69 | 460 |
| Example 48 | 5 | 0.64 | 0.68 | 480 |
| Example 49 | 5 | 0.64 | 0.68 | 480 |
| Example 50 | 5 | 0.64 | 0.68 | 480 |
| Example 51 | 5 | 0.64 | 0.68 | 490 |
| Example 52 | 5 | 0.65 | 0.69 | 480 |
| Example 53 | 5 | 0.64 | 0.68 | 480 |
| Example 54 | 5 | 0.64 | 0.68 | 480 |
| Example 55 | 5 | 0.62 | 0.66 | 520 |
| Example 56 | 5 | 0.65 | 0.69 | 480 |
| Example 57 | 5 | 0.64 | 0.68 | 480 |
| Example 58 | 5 | 0.67 | 0.71 | 440 |
| Example 59 | 5 | 0.67 | 0.71 | 440 |
| Example 60 | 5 | 0.67 | 0.71 | 430 |
| Example 61 | 5 | 0.67 | 0.71 | 440 |
| Example 62 | 5 | 0.70 | 0.74 | 420 |
| Example 63 | 5 | 0.65 | 0.69 | 440 |
| Example 64 | 5 | 0.68 | 0.72 | 420 |
| Example 65 | 5 | 0.70 | 0.74 | 350 |
| Example 66 | 5 | 0.62 | 0.66 | 490 |
| Example 67 | 5 | 0.62 | 0.66 | 500 |
| Example 68 | 5 | 0.62 | 0.66 | 450 |
| Example 69 | 5 | 0.62 | 0.66 | 480 |
| Example 70 | 5 | 0.65 | 0.69 | 460 |
| Example 71 | 5 | 0.65 | 0.69 | 460 |
| Example 72 | 5 | 0.65 | 0.69 | 420 |
| Example 73 | 5 | 0.65 | 0.69 | 430 |
| Example 74 | 5 | 0.78 | 0.82 | 210 |
| Example 75 | 5 | 0.75 | 0.79 | 300 |
| Example 76 | 8 | 0.71 | 0.75 | 380 |
| Example 77 | 13 | 0.63 | 0.67 | 620 |
| Example 78 | 15 | 0.63 | 0.67 | 600 |
| Example 79 | 18 | 0.61 | 0.65 | 800 |
| Example 80 | 5 | 0.65 | 0.69 | 460 |
| Example 81 | 5 | 0.65 | 0.69 | 460 |
| Example 82 | 5 | 0.65 | 0.69 | 460 |
| Example 83 | 5 | 0.65 | 0.69 | 470 |
| Example 84 | 5 | 0.65 | 0.69 | 460 |
| Example 85 | 5 | 0.65 | 0.69 | 460 |
| Example 86 | 10 | 0.65 | 0.69 | 470 |
| Example 87 | 5 | 0.65 | 0.69 | 460 |
| Example 88 | 5 | 0.65 | 0.69 | 460 |
| Example 89 | 5 | 0.65 | 0.69 | 460 |
| Example 90 | 5 | 0.65 | 0.69 | 420 |
| Example 91 | 5 | 0.78 | 0.82 | 210 |
| Example 92 | 8 | 0.71 | 0.75 | 380 |
| Example 93 | 12 | 0.63 | 0.67 | 620 |
| Example 94 | 16 | 0.62 | 0.65 | 800 |

TABLE 8

| | Potential variation (V) | Initial torque relative value | Torque relative value after repeated use of 2,000 sheets of paper | Particle size (nm) |
|---|---|---|---|---|
| Example 95 | 5 | 0.65 | 0.69 | 420 |
| Example 96 | 5 | 0.65 | 0.69 | 410 |

TABLE 8-continued

| | Potential variation (V) | Initial torque relative value | Torque relative value after repeated use of 2,000 sheets of paper | Particle size (nm) |
|---|---|---|---|---|
| Example 97 | 5 | 0.63 | 0.67 | 420 |
| Example 98 | 10 | 0.65 | 0.69 | 420 |
| Example 99 | 10 | 0.65 | 0.69 | 410 |
| Example 100 | 10 | 0.65 | 0.69 | 420 |
| Example 101 | 10 | 0.65 | 0.69 | 430 |
| Example 102 | 10 | 0.65 | 0.69 | 430 |
| Example 103 | 10 | 0.63 | 0.67 | 420 |
| Example 104 | 10 | 0.65 | 0.69 | 500 |
| Example 105 | 5 | 0.65 | 0.69 | 520 |
| Example 106 | 5 | 0.65 | 0.69 | 510 |
| Example 107 | 5 | 0.65 | 0.69 | 550 |
| Example 108 | 5 | 0.65 | 0.69 | 500 |
| Example 109 | 5 | 0.65 | 0.69 | 460 |
| Example 110 | 5 | 0.65 | 0.68 | 460 |
| Example 111 | 5 | 0.65 | 0.68 | 460 |
| Example 112 | 5 | 0.65 | 0.68 | 460 |
| Example 113 | 5 | 0.65 | 0.68 | 460 |
| Example 114 | 5 | 0.65 | 0.68 | 460 |
| Example 115 | 8 | 0.65 | 0.68 | 450 |
| Example 116 | 5 | 0.65 | 0.68 | 460 |
| Example 117 | 5 | 0.65 | 0.68 | 460 |
| Example 118 | 5 | 0.65 | 0.68 | 470 |
| Example 119 | 5 | 0.65 | 0.68 | 460 |
| Example 120 | 5 | 0.65 | 0.68 | 460 |
| Example 121 | 5 | 0.65 | 0.68 | 460 |
| Example 122 | 10 | 0.65 | 0.68 | 460 |
| Example 123 | 10 | 0.65 | 0.68 | 460 |
| Example 124 | 10 | 0.65 | 0.68 | 460 |
| Example 125 | 10 | 0.65 | 0.68 | 460 |
| Example 126 | 10 | 0.65 | 0.68 | 460 |
| Example 127 | 10 | 0.65 | 0.68 | 460 |
| Example 128 | 10 | 0.65 | 0.68 | 460 |
| Example 129 | 10 | 0.65 | 0.68 | 460 |
| Example 130 | 10 | 0.65 | 0.68 | 450 |
| Example 131 | 10 | 0.65 | 0.68 | 460 |
| Example 132 | 10 | 0.65 | 0.68 | 460 |
| Example 133 | 10 | 0.65 | 0.68 | 460 |
| Example 134 | 10 | 0.65 | 0.68 | 470 |
| Example 135 | 10 | 0.65 | 0.68 | 460 |
| Example 136 | 10 | 0.65 | 0.68 | 460 |
| Example 137 | 10 | 0.65 | 0.68 | 460 |
| Example 138 | 10 | 0.65 | 0.68 | 460 |
| Example 139 | 10 | 0.65 | 0.68 | 460 |
| Example 140 | 10 | 0.65 | 0.70 | 460 |
| Example 141 | 8 | 0.65 | 0.68 | 450 |
| Example 142 | 8 | 0.65 | 0.68 | 440 |
| Example 143 | 10 | 0.65 | 0.70 | 450 |
| Example 144 | 5 | 0.75 | 0.78 | 280 |
| Example 145 | 8 | 0.72 | 0.75 | 380 |
| Example 146 | 15 | 0.64 | 0.67 | 500 |
| Example 147 | 20 | 0.61 | 0.64 | 560 |
| Example 148 | 10 | 0.65 | 0.68 | 450 |
| Example 149 | 10 | 0.65 | 0.68 | 460 |
| Example 150 | 10 | 0.65 | 0.68 | 460 |
| Example 151 | 10 | 0.65 | 0.68 | 460 |
| Example 152 | 10 | 0.65 | 0.68 | 460 |
| Example 153 | 10 | 0.65 | 0.68 | 460 |
| Example 154 | 10 | 0.65 | 0.68 | 460 |
| Example 155 | 10 | 0.65 | 0.68 | 460 |
| Example 156 | 10 | 0.65 | 0.68 | 470 |
| Example 157 | 10 | 0.65 | 0.68 | 460 |
| Example 158 | 10 | 0.65 | 0.68 | 460 |
| Example 159 | 10 | 0.65 | 0.68 | 460 |
| Example 160 | 10 | 0.65 | 0.68 | 460 |
| Example 161 | 10 | 0.65 | 0.68 | 460 |
| Example 162 | 10 | 0.65 | 0.68 | 460 |
| Example 163 | 10 | 0.65 | 0.68 | 460 |
| Example 164 | 10 | 0.65 | 0.68 | 460 |
| Example 165 | 10 | 0.65 | 0.68 | 460 |
| Example 166 | 10 | 0.65 | 0.68 | 460 |
| Example 167 | 12 | 0.64 | 0.67 | 480 |
| Example 168 | 12 | 0.64 | 0.67 | 480 |
| Example 169 | 12 | 0.64 | 0.67 | 480 |
| Example 170 | 12 | 0.64 | 0.67 | 480 |
| Example 171 | 12 | 0.64 | 0.67 | 480 |
| Example 172 | 12 | 0.64 | 0.67 | 480 |

TABLE 8-continued

| | Potential variation (V) | Initial torque relative value | Torque relative value after repeated use of 2,000 sheets of paper | Particle size (nm) |
|---|---|---|---|---|
| Example 173 | 12 | 0.64 | 0.67 | 480 |
| Example 174 | 14 | 0.63 | 0.66 | 500 |
| Example 175 | 12 | 0.64 | 0.67 | 480 |
| Example 176 | 12 | 0.64 | 0.67 | 480 |
| Example 177 | 10 | 0.67 | 0.70 | 460 |
| Example 178 | 5 | 0.72 | 0.75 | 250 |
| Example 179 | 18 | 0.62 | 0.65 | 600 |
| Example 180 | 8 | 0.65 | 0.68 | 430 |
| Example 181 | 8 | 0.65 | 0.68 | 430 |
| Example 182 | 8 | 0.65 | 0.68 | 430 |
| Example 183 | 12 | 0.64 | 0.67 | 430 |
| Example 184 | 11 | 0.65 | 0.68 | 470 |
| Example 185 | 12 | 0.65 | 0.68 | 450 |
| Example 186 | 12 | 0.64 | 0.67 | 430 |
| Example 187 | 12 | 0.64 | 0.67 | 450 |
| Example 188 | 12 | 0.65 | 0.68 | 440 |
| Example 189 | 8 | 0.65 | 0.68 | 440 |
| Example 190 | 8 | 0.65 | 0.68 | 440 |
| Example 191 | 11 | 0.65 | 0.68 | 440 |
| Example 192 | 9 | 0.67 | 0.70 | 460 |
| Example 193 | 5 | 0.72 | 0.75 | 250 |
| Example 194 | 16 | 0.62 | 0.66 | 600 |

TABLE 9

| | Potential variation (V) | Initial torque relative value | Torque relative value after repeated use of 2,000 sheets of paper | Particle size (nm) |
|---|---|---|---|---|
| Comparative Example 1 | 5 | 0.93 | 0.98 | — |
| Comparative Example 2 | 7 | 0.92 | 0.95 | — |
| Comparative Example 3 | 7 | 0.93 | 0.95 | — |
| Comparative Example 4 | 7 | 0.91 | 0.95 | — |
| Comparative Example 5 | 7 | 0.92 | 0.95 | — |
| Comparative Example 6 | 5 | 0.93 | 0.95 | — |
| Comparative Example 7 | 5 | 0.93 | 0.98 | — |
| Comparative Example 8 | 5 | 0.93 | 0.97 | — |
| Comparative Example 9 | 5 | 0.93 | 0.95 | — |
| Comparative Example 10 | 7 | 0.91 | 0.94 | — |
| Comparative Example 11 | 7 | 0.88 | 0.95 | — |
| Comparative Example 12 | 7 | 0.89 | 0.95 | — |
| Comparative Example 13 | 7 | 0.92 | 0.94 | — |
| Comparative Example 14 | 8 | 0.93 | 0.95 | — |
| Comparative Example 15 | 7 | 0.91 | 0.95 | — |
| Comparative Example 16 | 8 | 0.92 | 0.95 | — |
| Comparative Example 17 | 15 | 0.87 | 0.93 | — |
| Comparative Example 18 | 150 | 0.65 | 0.70 | 1,000 |
| Comparative Example 19 | 140 | 0.64 | 0.73 | 1,000 |
| Comparative Example 20 | 170 | 0.68 | 0.74 | 1,000 |
| Comparative Example 21 | 150 | 0.65 | 0.68 | 1,050 |

TABLE 9-continued

| | Potential variation (V) | Initial torque relative value | Torque relative value after repeated use of 2,000 sheets of paper | Particle size (nm) |
|---|---|---|---|---|
| Comparative Example 22 | 150 | 0.68 | 0.73 | 950 |
| Comparative Example 23 | 180 | 0.63 | 0.67 | 1,250 |
| Comparative Example 24 | 80 | 0.67 | 0.78 | 750 |
| Comparative Example 25 | 75 | 0.69 | 0.79 | 750 |
| Comparative Example 26 | 90 | 0.67 | 0.78 | 750 |
| Comparative Example 27 | 80 | 0.67 | 0.80 | 780 |
| Comparative Example 28 | 80 | 0.68 | 0.78 | 730 |
| Comparative Example 29 | 100 | 0.67 | 0.78 | 900 |
| Comparative Example 30 | 200 | 0.60 | 0.65 | — |
| Comparative Example 31 | 60 | 0.68 | 0.73 | 400 |
| Comparative Example 32 | 60 | 0.69 | 0.73 | 400 |
| Comparative Example 33 | 70 | 0.68 | 0.76 | 400 |
| Comparative Example 34 | 60 | 0.70 | 0.78 | 350 |
| Comparative Example 35 | 60 | 0.68 | 0.78 | 400 |
| Comparative Example 36 | 58 | 0.68 | 0.78 | 400 |
| Comparative Example 37 | 95 | 0.77 | 0.93 | — |
| Comparative Example 38 | 110 | 0.75 | 0.98 | — |
| Comparative Example 39 | 85 | 0.80 | 0.96 | — |
| Comparative Example 40 | 88 | 0.80 | 0.96 | — |
| Comparative Example 41 | 43 | 0.68 | 0.75 | 400 |
| Comparative Example 42 | 40 | 0.69 | 0.75 | 350 |
| Comparative Example 43 | 43 | 0.68 | 0.75 | 400 |
| Comparative Example 44 | 40 | 0.65 | 0.73 | 450 |
| Comparative Example 45 | 40 | 0.69 | 0.74 | 270 |
| Comparative Example 46 | 38 | 0.65 | 0.72 | 350 |

A comparison between Examples and Comparative Examples 1 to 16 reveals that, in the case where the content of siloxane relative to the polyester resin having the siloxane moiety in the charge-transporting layer is low, no matrix-domain structure is found and the effect of reducing contact stress is insufficient. This is shown by the fact that the effect of reducing the torque was not obtained at the initial time and after repeated use of 2,000 sheets of the paper. Further, Comparative Examples 17 shows that, in the case where the content of siloxane relative to the polyester resin having the siloxane moiety is low, the effect of reducing contact stress is insufficient even if the content of the siloxane-containing resin in the charge-transporting layer is increased.

A comparison between Examples and Comparative Examples 18 to 29 reveals that, in the case where the content of siloxane relative to the polyester resin having the siloxane moiety in the charge-transporting layer is high, potential stability in repeated use is insufficient. In this case, although the matrix-domain structure due to the polyester resin containing the siloxane moiety is formed, the polyester resin and the charge-transporting layer have excessive amounts of the siloxane structure, and hence compatibility with the charge-transporting substance is insufficient. Therefore, the effect for potential stability in repeated use is insufficient. Further, Comparative Example 30 shows that the potential stability in repeated use is insufficient. The results of Comparative Example 30 show that a large potential variation is caused even though the matrix-domain structure is not formed. That is, in Comparative Examples 18 to 30, the resultant member contains the charge-transporting substance and the resin containing excessive amounts of the siloxane structure, and hence compatibility with the charge-transporting substance may be insufficient.

A comparison between Examples and Comparative Examples 31 to 36 reveals that, the charge-transporting substances shown in the present invention have insufficient potential stability in some cases even if the matrix-domain structure is formed with the resin having the siloxane structure. A comparison between Examples and Comparative Examples 31 to 36 reveals that the potential stability in repeated use can be improved by using the polyester resin of the present invention. The comparison further shows that an excellent balance between sufficient effect for the potential stability and sustained reduction of contact stress can be achieved in Examples. In Comparative Examples 31 to 36, the potential stability may be insufficient because the component γ having high compatibility with the resin in the charge-transporting layer contains a large amount of the charge-transporting substance in the domain including the siloxane-containing resin, resulting in formation of aggregates of the charge-transporting substance in the domain. However, in Examples, compatibility between the components α and the components γ of the present invention is low, and hence the content of the charge-transporting substance in the domain may be reduced. Thus, it is estimated that the content of the charge-transporting substance in the domain, which is a factor for the potential variation, is reduced, to thereby provide an excellent effect for the potential stability. The fact that the potential stability in repeated use is improved by the compatibility between the components α and γ is suggested by the results of Comparative Examples 41 to 46. A comparison between Comparative Examples 31 to 36 and Examples reveals that a significant effect of suppressing the potential variation can be obtained in the case of forming the charge-transporting layer containing the components α and γ of the present invention.

A comparison between Examples and Comparative Examples 37 to 40 reveals that the resin described in Patent Literature 2 does not form a matrix-domain structure even when used together with the polyester resin C or the polyester resin D and does not provide a sufficient effect of reducing contact stress, resulting in a large potential variation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-269732, filed Dec. 2, 2010, which is hereby incorporated by reference herein in its entirety.

The invention claimed is:

1. An electrophotographic photosensitive member, comprising:

a conductive support, a charge-generating layer which is provided on the conductive support and comprises a charge-generating substance, and a charge-transporting layer which is provided on the charge-generating layer and is a surface layer of the electrophotographic photosensitive member;

wherein the charge-transporting layer has a matrix-domain structure having:

a domain which comprises a polyester resin A having a repeating structural unit represented by the following formula (A) and a repeating structural unit represented by the following formula (B); and a matrix which comprises, at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1), a compound represented by the following formula (1'), a compound represented by the following formula (2), and a compound represented by the following formula (2');

wherein the content of a siloxane moiety in the polyester resin A is not less than 5.0% by mass and not more than 40% by mass relative to the total mass of the polyester resin A;

(A)

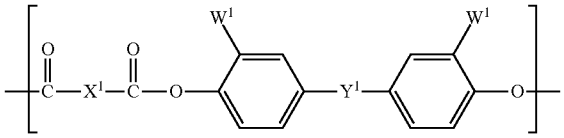

wherein, in the formula (A), $Y^1$ represents a single bond, a methylene group, an ethylidene group, a propylidene group, a phenylethylidene group, a cyclohexylidene group, or an oxygen atom;

$X^1$ represents a meta-phenylene group, a para-phenylene group, or a bivalent group having two para-phenylene groups bonded with an oxygen atom, and $W^1$ represents a univalent group represented by the following formula (a), or a univalent group represented by the following formula (b);

(a)

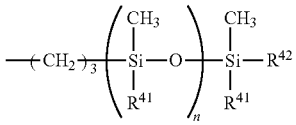

(b)

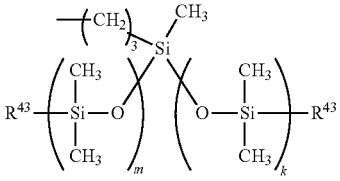

wherein, in the formulae (a) and (b), $R^{41}$ represents a methyl group, or a phenyl group, $R^{42}$ and $R^{43}$ each independently represents an alkyl group having 1 to 4 carbon atoms, "n" represents the number of repetitions of a structure within brackets, an average of "n" in the polyester resin A ranges from 10 to 150;

"m" and "k" each independently represents the number of repetitions of a structure within brackets, an average of "m+k" in the polyester resin A ranges from 10 to 150;

(B)

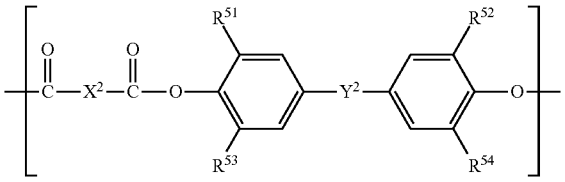

wherein, in the formula (B), $R^{51}$ to $R^{54}$ each independently represents a hydrogen atom, or a methyl group, $X^2$ represents a meta-phenylene group, a para-phenylene group, or a bivalent group having two para-phenylene groups bonded with an oxygen atom, and $Y^2$ represents a single bond, a methylene group, an ethylidene group, a propylidene group, a phenylethylidene group, a cyclohexylidene group, or an oxygen atom;

(C)

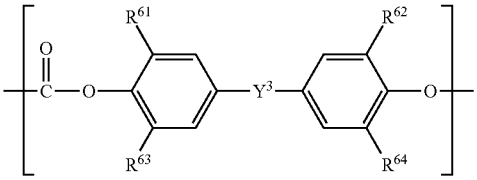

wherein, in the formula (C), $R^{61}$ to $R^{64}$ each independently represents a hydrogen atom, or a methyl group, and $Y^3$ represents a single bond, a methylene group, an ethylidene group, a propylidene group, a phenylethylidene group, a cyclohexylidene group, or an oxygen atom;

(D)

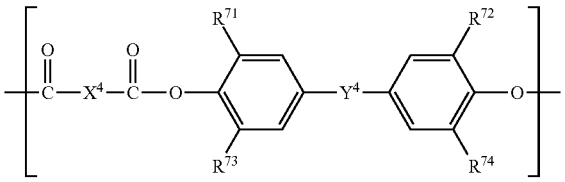

wherein, in the formula (D), $R^{71}$ to $R^{74}$ each independently represents a hydrogen atom, or a methyl group, $X^4$ represents a meta-phenylene group, a para-phenylene group, or a bivalent group having two para-phenylene groups bonded with an oxygen atom, and $Y^4$ represents a single bond, a methylene group, an ethylidene group, a propylidene group, a cyclohexylidene group, or an oxygen atom;

(1)

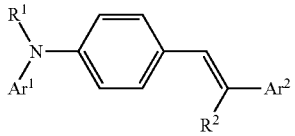

(1')

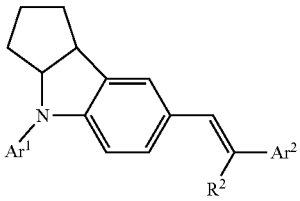

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with a univalent group represented by the formula "—CH═CH—Ta", or a biphenyl group substituted with a univalent group represented by the formula "—CH═CH—Ta" (where, Ta represents a univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with a univalent group represented by the formula "—CH═C($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group;

(2)

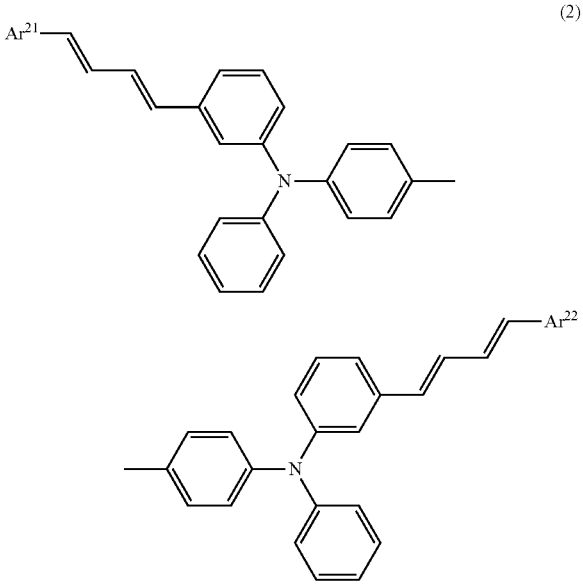

-continued (2')

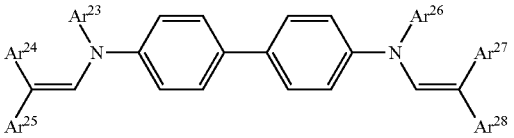

wherein, in the formulae (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group, and wherein the siloxane moiety in the polyester resin A is a moiety represented by one of the following formulae:

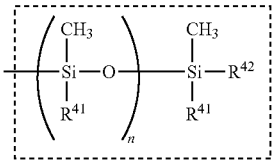

Siloxane moiety in formula (a)

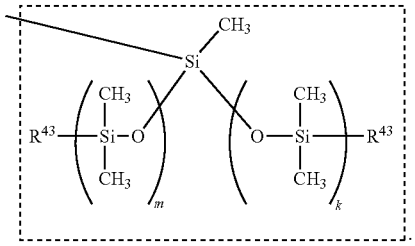

Siloxane moiety in formula (b)

2. The electrophotographic photosensitive member according to claim 1, wherein the content of the siloxane moiety in the charge-transporting layer is not less than 1% by mass and not more than 20% by mass relative to the total mass of whole resin in the charge-transporting layer.

3. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

4. An electrophotographic apparatus, comprising:

the electrophotographic photosensitive member according to claim 1; a charging device; an exposing device; a developing device; and a transferring device.

5. A method of manufacturing the electrophotographic photosensitive member according to claim 1, wherein the method comprises a step of forming the charge-transporting layer by applying a charge-transporting-layer coating solution on the charge-generating layer and drying the coating solution, and wherein the charge-transporting-layer coating solution comprises:

the polyester resin A, at least one resin selected from the group consisting of the polycarbonate resin C and the polyester resin D, and at least one charge-transporting substance selected from the group consisting of the compound represented by the formula (1), the compound represented by the formula (1'), the compound represented by the formula (2), and the compound represented by the formula (2').

6. The electrophotographic photosensitive member according to claim 1, wherein the charge-transporting substance is at least one compound selected from the group consisting of a compound represented by the formula (1), a compound represented by the formula (1'), and a compound represented by the formula (2').

* * * * *